US010018194B2

(12) United States Patent
Harvey

(10) Patent No.: US 10,018,194 B2
(45) Date of Patent: Jul. 10, 2018

(54) MICRO PUMPS

(71) Applicant: AtomJet Ltd., Cambridge (GB)

(72) Inventor: Robert Alan Harvey, Cambridge (GB)

(73) Assignee: ATOMJET LTD., Cambridge (GB)

( * ) Notice: Subject to any disclaimer, the term of this patent is extended or adjusted under 35 U.S.C. 154(b) by 463 days.

(21) Appl. No.: 14/416,662

(22) PCT Filed: Jul. 10, 2013

(86) PCT No.: PCT/GB2013/051830
§ 371 (c)(1),
(2) Date: Jan. 23, 2015

(87) PCT Pub. No.: WO2014/016562
PCT Pub. Date: Jan. 30, 2014

(65) Prior Publication Data
US 2015/0260181 A1 Sep. 17, 2015

(30) Foreign Application Priority Data
Jul. 26, 2012 (GB) ..... 1213346.8

(51) Int. Cl.
*F04B 49/00* (2006.01)
*F04B 45/047* (2006.01)
(Continued)

(52) U.S. Cl.
CPC ..... *F04B 49/005* (2013.01); *F04B 19/006* (2013.01); *F04B 43/026* (2013.01);
(Continued)

(58) Field of Classification Search
CPC ..... F04B 49/005; F04B 49/225; F04B 49/06; F04B 45/047; F04B 45/043; F04B 53/10;
(Continued)

(56) References Cited

U.S. PATENT DOCUMENTS 6,227,809 B1 * 5/2001 Forster ..... F04B 43/046 417/413.2
2002/0029814 A1 * 3/2002 Unger ..... B01L 3/502707 137/824
(Continued)

FOREIGN PATENT DOCUMENTS

DE 19938239 A1 3/2001
EP 2279789 A2 2/2011
(Continued)

OTHER PUBLICATIONS

International Search Report for corresponding International Appl. No. PCT/GB2013/051830 dated Sep. 20, 2013.
(Continued)

*Primary Examiner* — Devon Kramer
*Assistant Examiner* — Christopher Brunjes
(74) *Attorney, Agent, or Firm* — Ronald Fernando

(57) ABSTRACT

A micro pump is formed on a substrate having a common inlet channel and a common outlet channel by a plurality of pumping elements, each pumping element having an inlet coupled to the common inlet channel and an outlet coupled to the common outlet channel, the inlet and outlet connected by a microfluidic channel, the microfluidic channel comprising a valvular conduit having low fluid flow resistance in a direction from the inlet to the outlet and high fluid flow resistance in a direction from the outlet to the inlet, and an actuating element arranged to cause fluid to be pumped through the microfluidic channel from the inlet to the outlet, wherein the actuating element is based on one or more of piezoelectric, thermal, electrostatic or electromagnetic transduction. A controller is coupled to actuate the actuating elements at mutually staggered relative timing so as to produce a substantially continuous steady flow.

16 Claims, 25 Drawing Sheets

(51) Int. Cl.

| | |
|---|---|
| ***F04B 45/04*** | (2006.01) |
| ***F04B 49/22*** | (2006.01) |
| ***F04B 19/00*** | (2006.01) |
| ***F04B 43/04*** | (2006.01) |
| ***F04B 43/02*** | (2006.01) |
| ***F04B 49/06*** | (2006.01) |
| ***F04B 53/10*** | (2006.01) |

(52) U.S. Cl.
CPC ..... *F04B 43/043* (2013.01); *F04B 43/046* (2013.01); *F04B 45/043* (2013.01); *F04B 45/047* (2013.01); *F04B 49/06* (2013.01); *F04B 49/225* (2013.01); *F04B 53/10* (2013.01)

(58) Field of Classification Search
CPC .... F04B 43/026; F04B 43/043; F04B 43/046; F04B 19/006; F04B 43/14; F04B 43/095; F04B 43/09; F04B 43/12; F04B 45/067; F04B 45/08; F04B 49/065; F04B 43/0081; F04B 43/025; F04B 45/022
See application file for complete search history.

(56) References Cited

U.S. PATENT DOCUMENTS

| | | | | |
|---|---|---|---|---|
| 2004/0120836 | A1 | 6/2004 | Dai et al. | |
| 2004/0265182 | A1 | 12/2004 | Chen et al. | |
| 2009/0165876 | A1* | 7/2009 | Atkin ..... | B01L 3/502723 137/825 |
| 2011/0274566 | A1* | 11/2011 | Amirouche ..... | A61M 5/14224 417/322 |

FOREIGN PATENT DOCUMENTS

| | | | |
|---|---|---|---|
| JP | 10110681 | A | 4/1998 |
| JP | 2009216141 | A | 9/2009 |
| WO | 2007060523 | A1 | 5/2007 |

OTHER PUBLICATIONS

Search Report for corresponding Appl. No. GB1213346.8 dated Dec. 5, 2012.

* cited by examiner

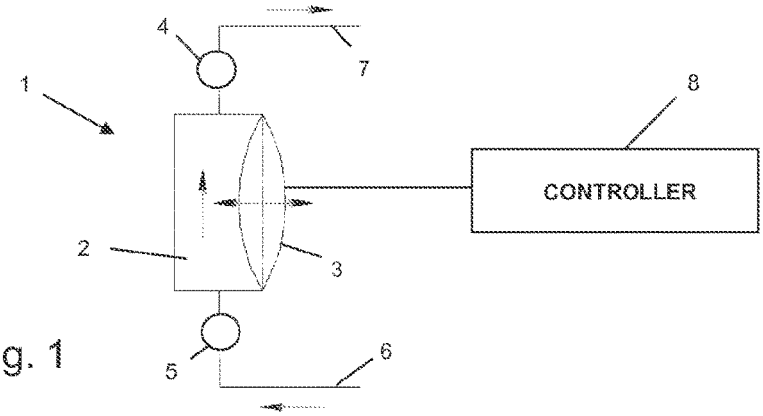
*(Prior Art)* Fig. 1
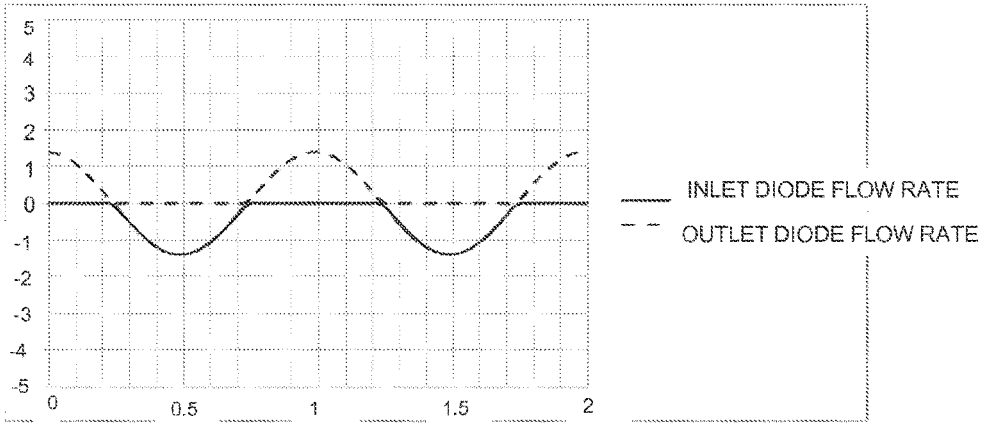
Fig. 2 *(Prior Art)*
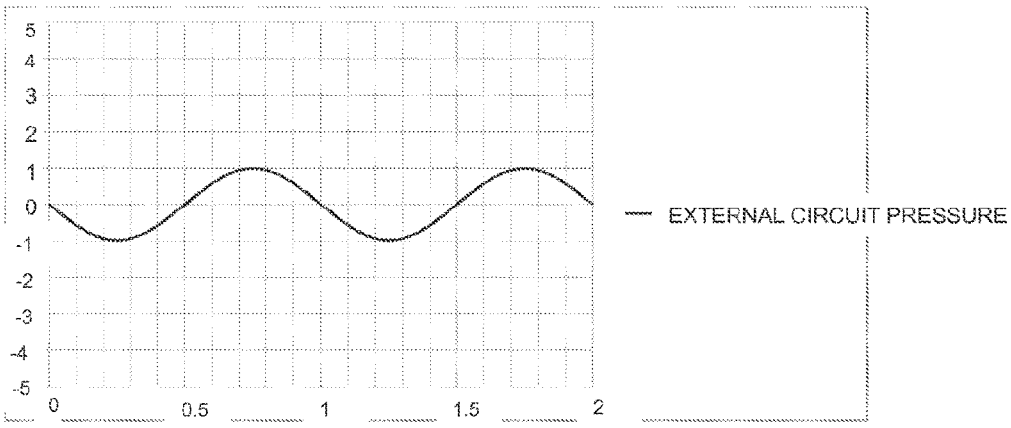
Fig. 3 *(Prior Art)*

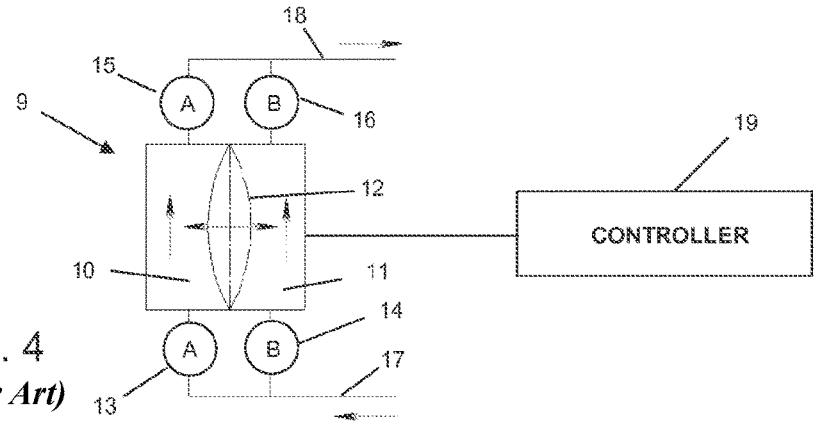
Fig. 4
*(Prior Art)*
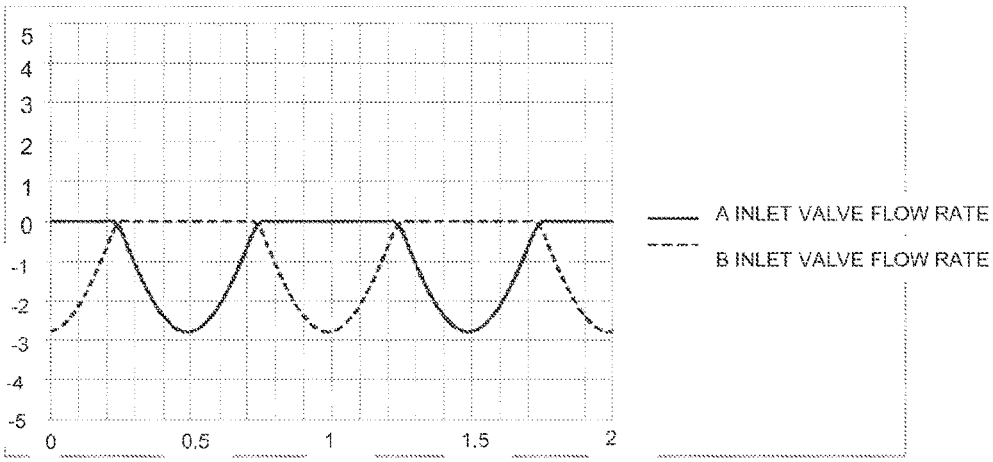
Fig. 5A *(Prior Art)*
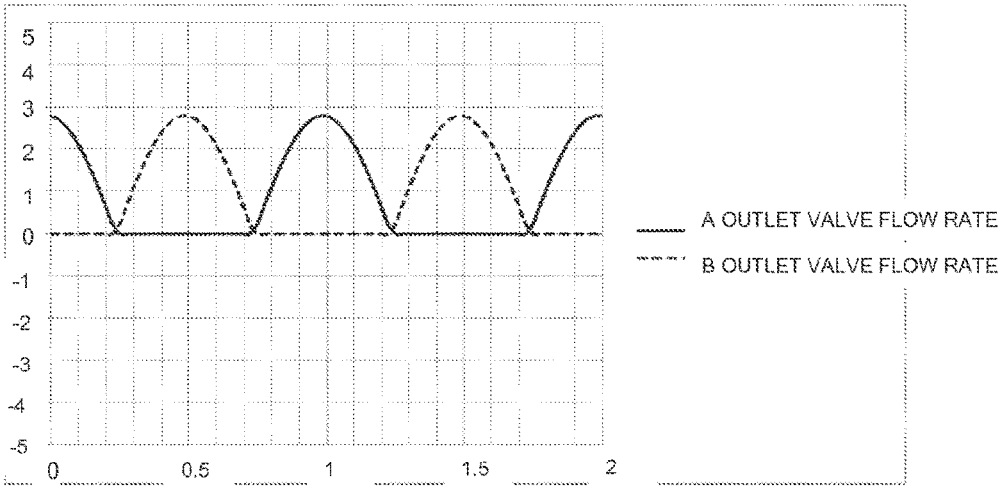
Fig. 5B *(Prior Art)*

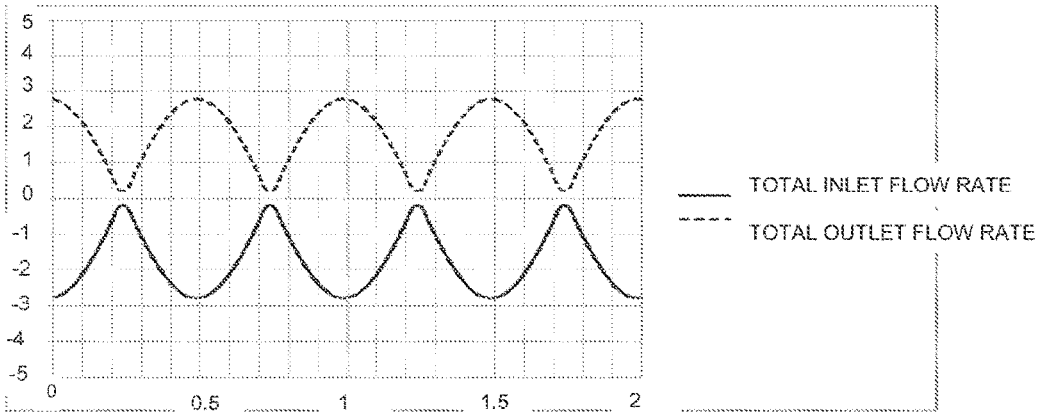
Fig. 5C *(Prior Art)*
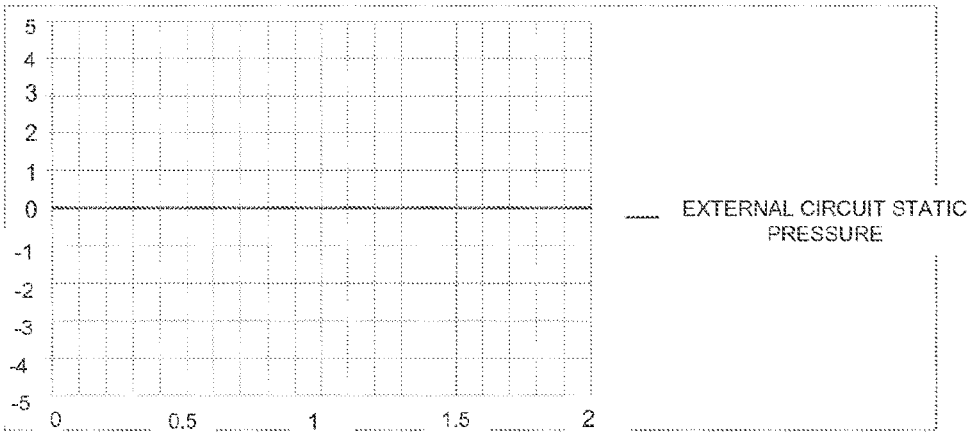
Fig. 6 *(Prior Art)*

Fig. 30A
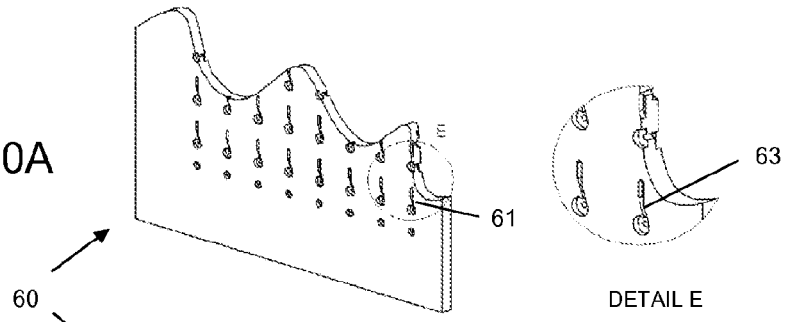
Fig. 30B
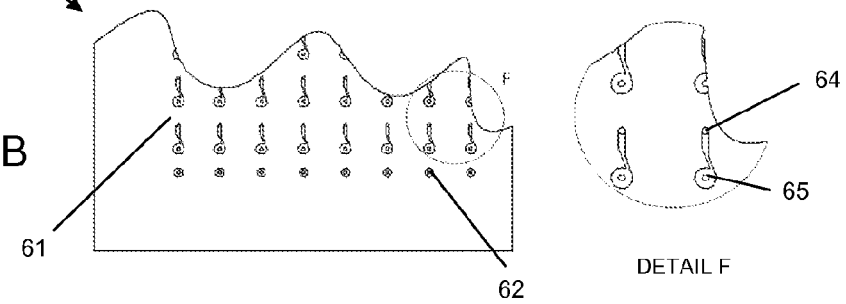
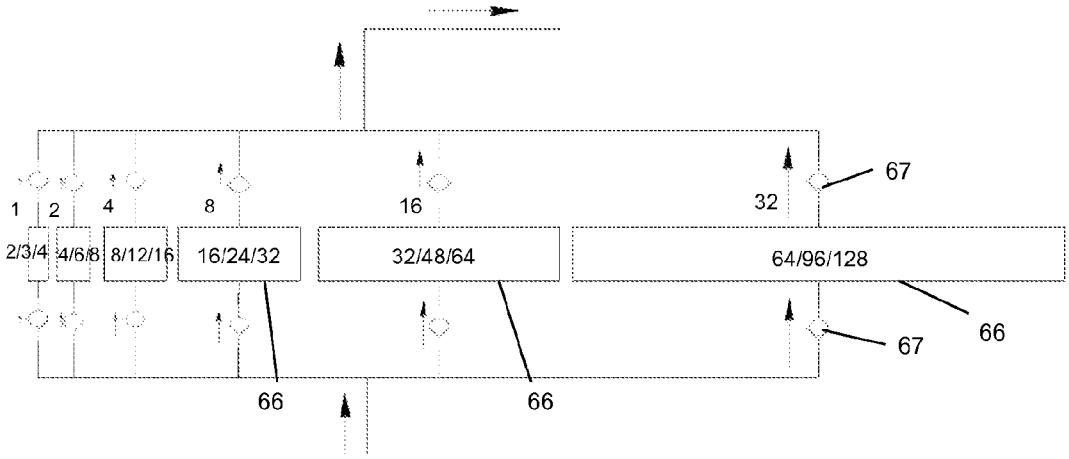
Fig. 31

Fig. 34B
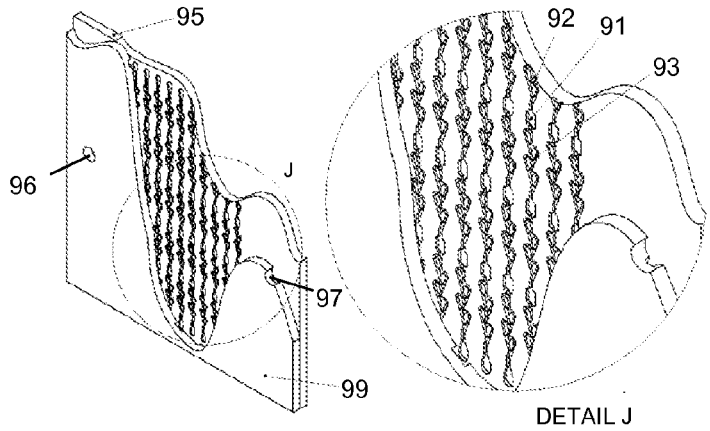
Fig. 35
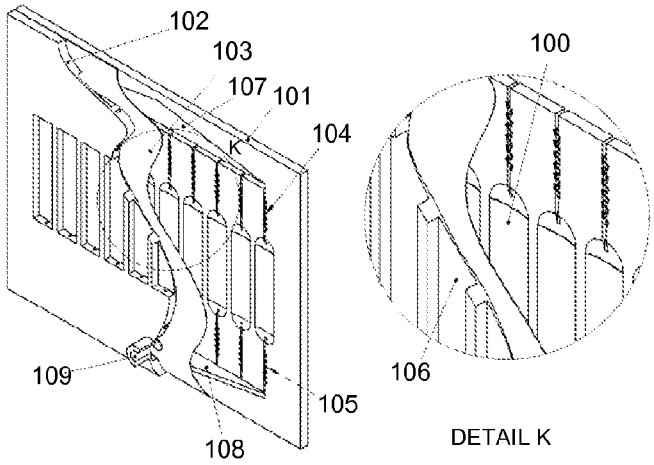
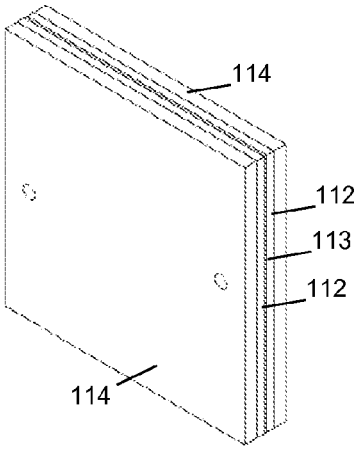
Fig. 36A
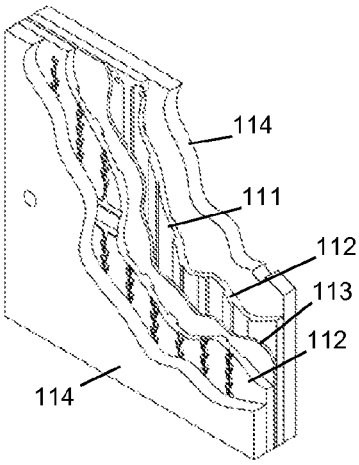
Fig. 36B
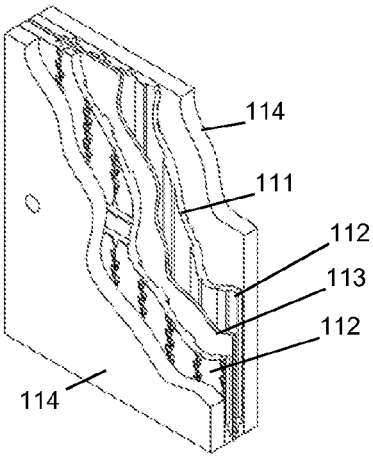
Fig. 36C

MICRO PUMPS

RELATED APPLICATIONS

This application claims the benefit of International Patent Application No. PCT/GB2013/051830, filed on Jul. 30, 2013, and Great Britain Patent Application No. GB1213346.8, filed on Jul. 26, 2012, and which are incorporated by reference herein.

FIELD OF INVENTION

This invention relates to micro pumps, particularly, though not exclusively to micro pumps that can deliver substantially constant flow rates of fluids, including liquids and gases, but have minimal moving parts. Particular embodiments relate to micro pumps with relatively high levels of volume flow compared to their internal volumes, low levels of pressure fluctuation and high rates of change of flow rates in response to changing levels of demand from the load. Some embodiments are capable of delivering high differential pressures at lower flow rates.

BACKGROUND

Pumps for transporting fluids from one point to another against a back pressure are well known, with some designs dating back hundreds or even thousands of years. The animal heart, with its muscle-driven, responsive, variable volume pumping chambers and integral non-return valves, represents a beautiful example of a pump created by nature.

In recent years there has been growing interest in the development of so-called micro pumps for pumping fluids. In general, this class of pump is physically compact, with dimensions ranging from a few millimeters to tens of millimeters, and having the ability to pump fluids at volume flow rates ranging from fractions of a milliliter up to a several milliliters per minute. The interest has been stimulated, firstly, by the availability of relatively cheap micro-machining techniques to enable such devices to be viable, both technically and commercially, and secondly by the realisation that many useful needs could be serviced by such devices.

Amongst these needs are those for medical applications including portable dialysis machines and intra-venous drug delivery, for instance of insulin. In the developing field of micro-fluidics, so-called lab-on-a-chip devices exploit the laminar flow characteristics of small cross-section liquid channels to perform a variety of chemical reactions, controlled mixing and liquid analysis, using very small volumes of liquids. These devices are finding increasing numbers of applications in bio-medical research. Many such de vices would benefit from the availability of a suitable and compatible micro pump either as a stand-alone or integrated component.

In the field of engineering, needs include the liquid or air cooling of microprocessors and other high power-density electronic devices, and also to the supply of ink to and around ink supplies for inkjet printers.

Pumping of air and gases is a broad field. Many applications require volumes to be pressurized, evacuated or recirculated. Some applications require merely that air or gas be moved past a surface, for instance in cooling or drying of an object.

There are a number of ways of classifying pumps and micro pumps. Macroscopic displacement pumps have slow speeds of response, due to the inertia of the motors and spindles driving the piston or diaphragm. In applications where demand can fluctuate rapidly, or where the demand is for very low levels of pressure fluctuation, for instance in inkjet ink supplies, this leads to the need for additional apparatus to control pressure. The additional apparatus may involve the use of weirs, pressure accumulators or dampers, leading to extra complexity and costs and to lower system functionality and reliability. In addition, the swept and priming volumes of such pumps are quite large, so that for applications where only a small volume of fluid is available or affordable, such pumps are quite unsuitable.

Applications that require the movement of volumes of gases against modest backpressures are dominated by rotating fans, either axial or centrifugal in design.

Applications that require smaller volumes to be pumped against higher back pressures, for charging pressure vessels to a few atmospheres of pressure, are dominated by piston and diaphragm pumps. The same is true of applications to evacuate pressure vessels to modest vacuums. Piston and diaphragm pumps produce acoustic noise and pressure pulses in the air stream. All such pumps are slow to start up and to turn off.

Fluctuations of pressure or flow rate produced by a pump as a result of the reciprocating action of diaphragms or pistons can be problematic for some of the possible applications for which it would otherwise be suitable. For instance, in the case of inkjet ink supply systems, pressure fluctuations from the pump that appear at the nozzles in the printhead cause unwanted variations in the mass of drops ejected and in the optical density of the patterns so formed. Many applications would benefit from faster speeds of response than are available from conventional motor driven piston or diaphragm-based pumps. For instance, paint spraying requires constant pressures when spraying, but usage is intermittent, thus requiring the use of heavy and bulky pneumatic reservoirs and pumps.

Micro pumps have been largely built around reciprocating diaphragms, with valves based either on flexible flaps or fixed geometries such as nozzle-diffuser devices. Such micro-pumps are generally capable of only very limited rates of flow, of up to about 16 milliliters per minute. Such rates of flow are usually too low to be useful for some of the intended applications, for instance in many inkjet ink supplies.

Another requirement for micro-pumps is for high energy efficiency. This is important for mobile applications, particularly those where power is supplied by batteries, in order to minimise the power consumption and to maximise the time that the device can ran on the battery.

Jamming of moving parts is another potential issue. Some of the intended applications use fluids that can cause moving parts to become jammed if the system is turned off for any length of time. Examples would be the pumping of blood, insulin or ink. Pumps featuring actuators with sliding surfaces, for instance between cylinders and pistons, and valves featuring contacting surfaces, such as flap or reed valves can suffer from reliability problems due to sticking of these sub-systems. In addition, these same sliding and moving surfaces can damage the fluid being pumped. In the case of biological fluids, an example would be the rapturing of cell membranes due to excessively high shear rates or pressure. In the case of Inkjet inks, it is known that high shear rates lead to removal of surfactant chemistries from the surfaces of pigment particles, leading to clumping and precipitation of the pigment particles. In air pumps, airborne dust can prevent the pump's non-return valves from seating properly and hence can degrade the efficiency of the pump.

It would therefore be desirable to produce a pump that is physically compact and produces a flow of fluid that is both responsive to the demands of the system in terms of flow rate and also does not introduce the cyclical pressure pulses that are usually associated with positive displacement pumps.

BRIEF SUMMARY OF THE INVENTION

Accordingly, in a first aspect, the invention provides a micro pump, comprising a common inlet channel, a common outlet channel, a plurality of pumping elements, each pumping element having an inlet coupled to the common inlet channel and an outlet coupled to the common outlet channel, the inlet and outlet being connected by a micro fluidic channel arranged on a substrate, a plurality of actuating elements arranged to cause fluid to be pumped through the microfluidic channels from the inlets to the outlets thereof; and a controller coupled to actuate the actuating elements so as to produce substantially continuous steady flow of the fluid at the common outlet channel.

Preferably, the actuating elements are configured to operate on any one or more of piezoelectric, thermal, electrostatic or electromagnetic transduction principles.

In one embodiment, the microfluidic channel comprises a valvular conduit having low fluid flow resistance in a direction from the inlet to the outlet and high fluid flow resistance in a direction from the outlet to the inlet.

Preferably, at least one of the valvular conduits comprises a rectifying structure, such as a plurality of topological micromixers that split, turn, and recombine the fluid arranged in series in the valvular conduit. For example, the rectifying structure may comprise a Tesla structure, a nozzle diffuser structure, or a vortex diode structure.

The valvular conduits may be made of any one or more of silicon, metal, ceramic or a polymeric plastics material.

In one embodiment, the controller actuates the actuating elements at mutually staggered relative timing, and preferably actuates the actuating elements to operate at substantially the same frequency, but shifted in phase to each other. Preferably, the controller may actuate the actuating elements in two or more phases, to move in such a way that the average speeds of the actuating walls or diaphragms, and therefore the rates of volumetric displacement within the actuating elements from the two or more phases sum to a constant total value at any given point in time throughout one or more cycles of operation.

In one embodiment, the actuating elements have a relatively high frequency response, and may have a natural resonant frequency that is five to ten times higher than a frequency at which the controller actuates the actuating element.

The actuating element may comprise a bubble generator for creating a bubble in the fluid by a heater, growth of the bubble causing propulsion of the fluid. Alternatively, the actuating element may comprise a piezoelectric transducer (PZT) diaphragm, or the actuating element may comprises a diaphragm driven by electrostatic forces or by elecromagnetic forces.

The micro pump is preferably formed in a micro-electro mechanical system (MEMS). In one embodiment, the micro pump may further comprise at least one mechanical non-return valve positioned between the common inlet channel and the inlets of one or more of the fluidic diodes, the mechanical non-return valve allowing flow into the respective microfluidic channel, but preventing reverse flows, and/or at least one mechanical non-return valve positioned between the common outlet channel and the outlets of one or more of the fluidic diodes, the mechanical non-return valve allowing flow out of the respective microfluidic channel, but preventing reverse flows.

In one embodiment, the micro pump may comprise a plurality of non-return valves positioned in the common inlet channel and in the common outlet channel between one or more of the inlets of the pumping members so as to sub-divide the plurality of pumping members into a number of functional blocks, for example, an array of functional blocks, where the functional blocks of the array have an increasing n umber of pumping members within each functional block that increases as a binary series: 1; 2; 4; 8; 16; 32 etc.

BRIEF DESCRIPTION OF THE DRAWINGS

Various embodiments of the invention will now be described in greater detail, by way of example only, with reference to the accompanying drawings, of which:

FIG. 1 shows a schematic diagram of a known single chamber pump;

FIG. 2 shows inlet and outlet flow rates for the pump of FIG. 1;

FIG. 3 shows static pressure in a system pumped by the pump of FIG. 1;

FIG. 4 shows a schematic diagram of a known two chamber pump;

FIGS. 5A-C shows inlet, outlet and total flow rates for the pump of FIG. 4 with sinusoidal actuation;

FIG. 6 shows static pressure in a system pumped by the pump of FIG. 4 with sinusoidal actuation;

FIGS. 30A-B show schematic isometric and plan views of a vortex diode array that may be used in the pump of FIG. 10;

FIG. 31 shows a schematic diagram of the pump of FIG. 10 divided into functional blocks;

FIGS. 34A-B show schematic perspective view of both sides of a pump with a bubble actuator and a Tesla diode array;

FIG. 35 shows a schematic perspective view of a pump with an electrostatically actuated Tesla diode array; and FIGS. 36A-C show perspective views, with varying cut-away amounts, of a pump similar to that of FIG. 32, but without a shared wall.

DETAILED DESCRIPTION OF THE DRAWINGS

Figure 7:
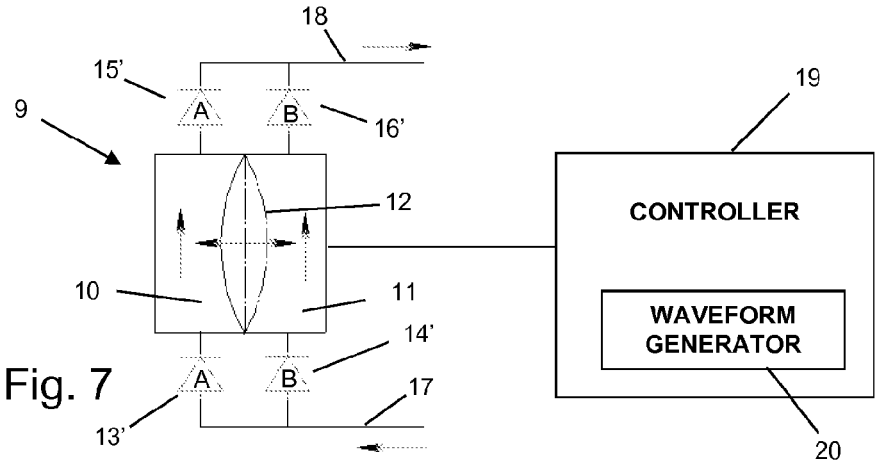
FIG. 7 shows a schematic diagram of a two chamber pump according to one embodiment of the present invention.

A schematic of a simple miniature positive displacement pump 1 is shown in FIG. 1. It shows a channel 2 with an internal volume that is cyclically increased and decreased by flexing one or more of the channel walls 3 under the control of a controller 8. The internal volume of the channel 2 is connected to a pair of non-return valves 4, 5 between an inlet 6 and the pump channel 2 and between the pump channel 2 and an outlet 7, respectively. The channel 2 will start from a neutral position and draw in fluid forwards from the inlet 6 through the inlet non-return valve 5, by increasing its internal volume by flexing one or more of its walls 3. The inward flow continues until the channel 2 reaches its maximum displacement (when it reaches its maximum volume). Then, as the channel 2 starts to contract, fluid begins to flow out of the outlet 7, while flow backwards to the inlet 6 is resisted by the inlet non-return valve 5. This process continues until the channel 2 reaches its maximum displacement in the opposite sense (when it reaches its minimum volume). Finally, the channel 2 will start to increase its volume again and to draw fluid in through the inlet non-return valve 5 by once again reversing the direction of the flexing of the wall 3, until the initial state is once again reached. This cycle is repeated for as long as the fluid needs to be pumped. All such pumps produce cyclically varying rates of flow and varying static pressure in the external circuit.

A system consisting of a single channel and pair of valves, as described above, will give rise to two problems. Firstly, it will produce an intermittent flow both at the inlet and outlet to the sub-system, as shown in FIG. 2. Secondly, as the internal volume of the channel changes, fluid is exchanged with the external circuit, so that the volume in the external circuit also changes, and with it the static pressure, but in the opposite sense to that in the pumping channel, as shown in FIG. 3. In the case of a closed loop system with low volumetric compliance and where control of static pressure is critical, such as in re-circulating ink supply systems for inkjet, this would need to be addressed using systems of weirs or pressure accumulators, thus adding cost, complexity and size to the system.

Similarly, FIG. 4 shows a dual-channel pump 9, having a pair of parallel channels 10 and 11 having a common wall 12. An inlet 17 is coupled to each of the channels 10 and 11, via valves 13 and 14, respectively and an outlet 18 is coupled to each of the channels 10 and 11 via valves 16 and 17. In this case, as will be appreciated, when the common wall 12 is flexed in one direction under the control of a controller 19, for example to the left as shown in FIG. 4, the right-hand channel 11 increases in volume and valve 14 allows fluid to pass into the right-hand channel 11 from the inlet 17, while valve 16 isolates the right-hand channel 11 from the outlet 18. At the same time, left-hand channel 10 is reduced in volume, causing fluid to pass therefrom through the valve 15 to the outlet 18, while valve 13 prevents fluid flow therethrough back to the inlet 17. When the common wall 12 is flexed in the opposite direction, i.e. to the right as shown in FIG. 4, the opposite happens, so that the left-hand channel 10 increases in volume and valve 13 allows fluid to pass into the left-hand channel 10 from the inlet 17, while valve 15 isolates the left-hand channel 10 from the outlet 18. At the same time, right-hand channel 11 is reduced in volume, causing fluid to pass therefrom through the valve 16 to the outlet 18, while valve 14 prevents fluid flow therethrough back to the inlet 17.

If the common wall 11 is actuated by the controller 19 to flex in a normal, sinusoidal fashion from one side to the other, the inlet flow rates through the two inlet valve 13, 14 will be in opposite phase to each other, as the common wall 11 flexes from one side to the other, as shown in FIG. 5A, with FIG. 5B showing the outlet flow rate through the two outlet valve 15, 16, also in opposite phase to each other, and to their respective inlet valves. FIG. 5C shows the total inlet and outlet flow rates as the combination of the flow rates through the inlet valves and the outlet valves, respectively, and shows that the input and output flow rates are part-sinusoidal. FIG. 6 shows that the overall static pressure in the external circuit, being a combination of the total inlet and outlet flow rates, is therefore zero.

FIG. 7 shows a dual-channel pump according to one embodiment of the present invention, similar to that of FIG. 4, but where the non-return valves are replaced by fluidic diodes, as will be further described below. In FIG. 7, the same elements of the pump as the elements of the pump of FIG. 4 have the same reference numerals. Thus, the fluidic diodes 13', 14', 15' and 16' are symbolically represented by an electrical diode symbol, in order to distinguish them from the mechanical non-return valves.

Furthermore, the controller 19 includes a waveform generator 20 to enable the controller to control the common wall to be moved according to a different input waveform than the standard sinusoidal signal.

Figure 8A:
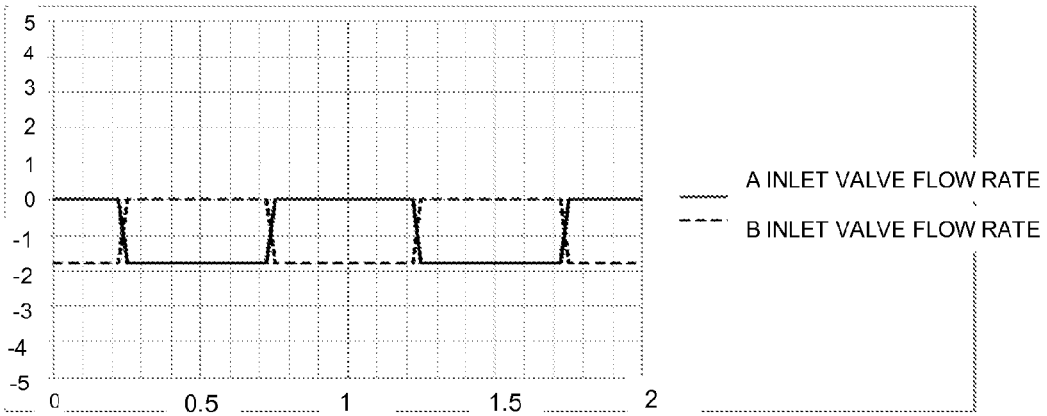
FIG. 8A-C shows inlet, outlet and total flow rates for the pump of FIG. 7 with triangular actuation.
Figure 8B:
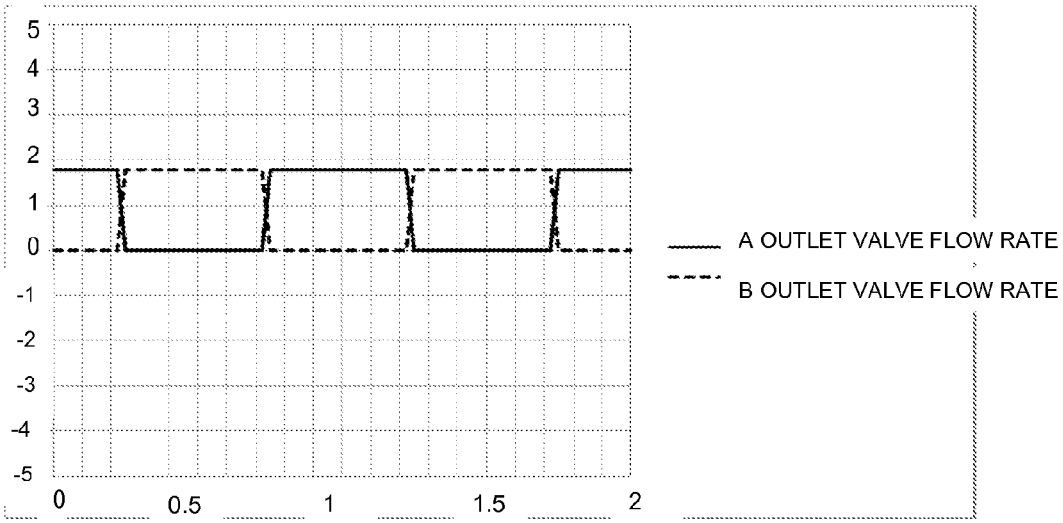
Figure 8C:
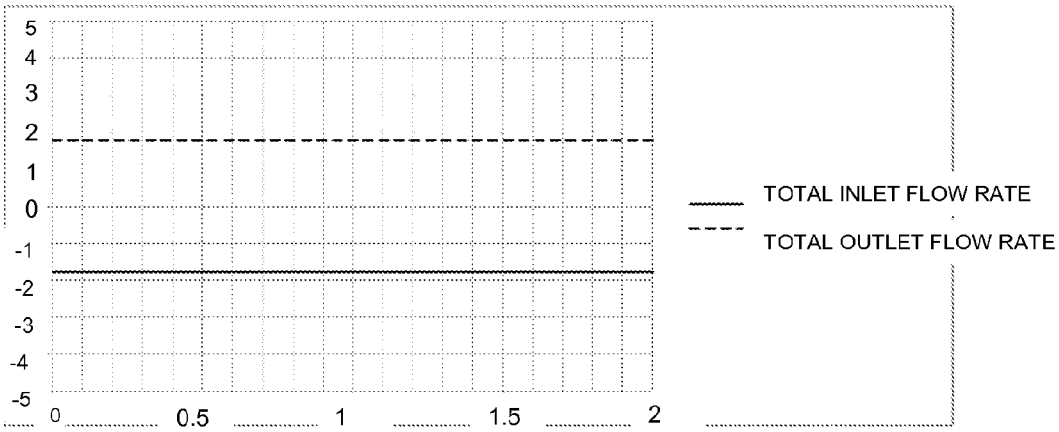
Figure 9:
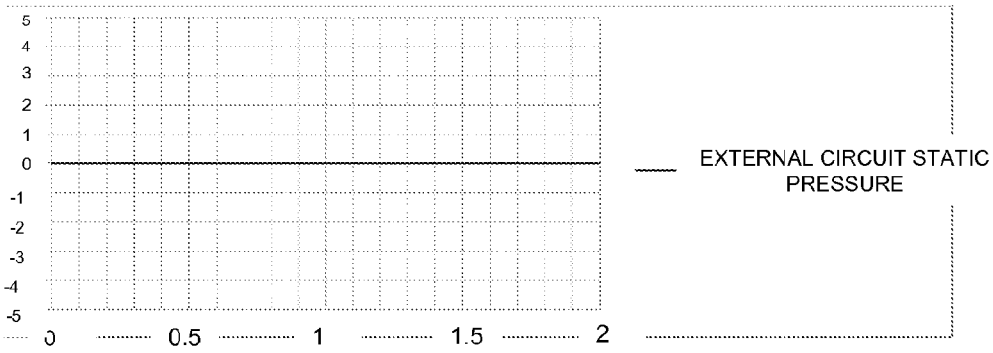
FIG. 9 shows static pressure in a system pumped by the pump of FIG. 7 with triangular actuation.

In one embodiment, the waveform generator 20 generates a triangular-shaped waveform. In this case, the inlet flow rates through the two inlet fluidic diodes (A & B) 13', 14' will again be in opposite phase to each other, as the common wall 11 ilexes from one side to the other, as shown in FIG. 8A, with FIG. 8B showing the outlet flow rate through the two outlet fluidic diodes (A & B) 16', 17', also in opposite phase to each other, and to their respective inlet fluidic diodes. FIG. 8C shows the total inlet and outlet flow rates as the combination of the flow rates through the inlet fluidic diodes and the outlet fluidic diodes, respectively, showing that, with a triangular-shaped actuation waveform, the input and output flow rates are no longer part-sinusoidal, as in the pump of FIG. 4, but are substantially constant. FIG. 9 shows that the overall static pressure in the external circuit, being a combination of the total inlet and outlet flow rates, is zero.

As will be described further below, triangular-shaped actuation waveforms are not the only waveforms that will produce substantially constant input and output flow rates.

For example, trapezoidal and parabolic waveforms will also produce substantially constant input and output flow rates.

Figure 10:
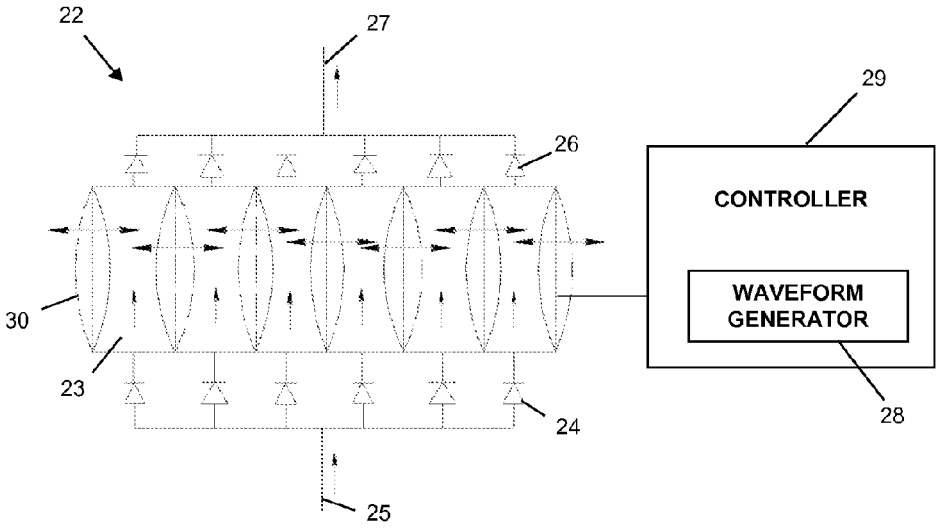
FIG. 10 shows a schematic diagram of a multi chamber pump according a second embodiment of the present invention having chambers operating in parallel.

FIG. 10 shows a multi-channel pump 22, similar to the dual-chamber pump of FIG. 7, but with a multiplicity of parallel pumping channels 23. In the drawing, six parallel pumping channels are shown, but it will be appreciated that more channels could be utilized as part of a larger array. As shown, each pumping channel 23 is connected to an inlet 25 via a respective inlet fluidic diode 24, and to an outlet 27 via a respective outlet fluidic diode 26. Again, waveform generator 28 generates a control waveform for controller 29 to control walls 30 between adjacent channels 23 in a two-phase mode, such that every second wall 30 is flexed on one direction and alternate walls 30 are flexed in the other direction, so that alternate channels are either compressed or expanded to force fluid out or in, respectively.

Figure 11:
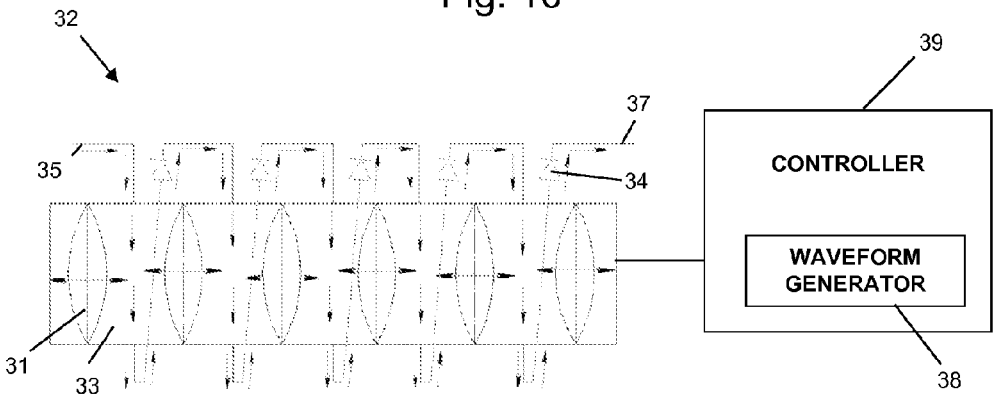
FIG. 11 shows a schematic diagram of a multi chamber pump according a further embodiment of the present invention having chambers operating in series.

FIG. 11 shows a multi-channel pump 32, similar to the multi-chamber pump of FIG. 10, but with a multiplicity of series pumping channels 33. In the drawing, six parallel pumping channels are shown, but it will be appreciated that more channels could be utilized as part of a larger array. As shown, each pumping channel 33 is connected, via a respective fluidic diode 34, to an outlet of the preceding pumping channel 33. The first pumping channel is connected to an inlet 35 and the final pumping channel 33 is connected to the outlet 37. Again, a waveform generator 38 generates a control waveform for controller 39 to control walls 31 between adjacent channels 33 in a two-phase mode, such that every second wall 31 is flexed on one direction and alternate walls 31 are flexed in the other direction, so that alternate channels are either compressed or expanded to force fluid out or in, respectively.

The electronic drive circuits forming the controller and the waveform generator can be realised using well-known techniques. However, the circuits will be required to take the particular voltage versus time profile definitions and to convert these faithfully to the levels of voltage and current required to cause the volume displacement elements to move as needed.

As used herein, the term "waveform" means the profile of voltage versus time applied by drive electronics forming the controller to piezo-electric or other types of actuators. It exploits the fact that because the piezo actuators behave linearly, wall displacements are proportional to voltages applied. The waveforms will, in general, be periodic in nature and will have the same profile from channel to channel. In a two-phase mode, ever}' other channel will be in phase, whilst the neighbour channels in between will be 180 degrees (or Pi Radians) out of phase. In a three-phase arrangement, every third channel will be in phase, whilst the neighbour channels in between will be 120 degrees and 240 degrees (or 2*Pi/3 and 4*Pi/3 Radians) out of phase. In a four-phase arrangement, every fourth channel will be in phase, whilst the neighbour channels in between will be 90 degrees, 180 degrees and 270 degrees (or Pi/2, Pi and 3*Pi/2 Radians) out of phase.

The waveform profiles are preferably designed to ensure that at any given instant, the total volume displaced from all of the phases combined is zero, or very close to zero. This ensures that the static pressure in the pumped system remains substantially constant. Beneficially, the waveform profiles are designed so that the volumes of the individual chambers change linearly with time, or are kept constant; that is, the waveform profiles are either triangular or trapezoidal. This means that the rates of change of volume are either constant or zero, in turn causing the rates of flow through the respective non-return valves to be constant or zero. This, in turn, means that it is possible for flows from separate elements to be added together at all instants in time to produce an overall constant rate of flow. Triangular waveforms may be arranged such that each actuating element moves from one end of its travel to the other in half a cycle and then back again in half a cycle. Three-phase trapezoidal waveforms are preferably arranged such that each actuating element moves from one end of its travel to the other in a third of a cycle, dwells for a sixth of a cycle, moves back again in a third of a cycle and dwells for a sixth of a cycle. Four-phase trapezoidal waveforms are arranged such that each actuating element moves from one end of its travel to the other in a quarter of a cycle, dwells for a quarter of a cycle, moves back again in a quarter of a cycle and dwells for a quarter of a cycle. Sinusoidal or other regular waveforms may also be used if the application does not demand minimal levels of flow rate or pressure fluctuation.

Figure 12A:
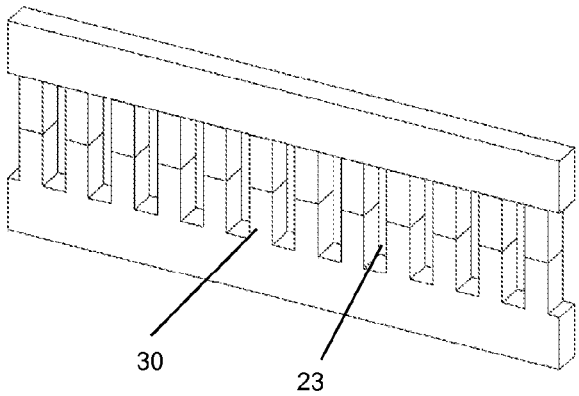
FIGS. 12A-D show part of a channel array of the multi-chamber pump of FIG. 10 operating with a two-phase actuation with the walls of the channels at zero, one-quarter, half and three-quarter phase positions.
Figure 12B:
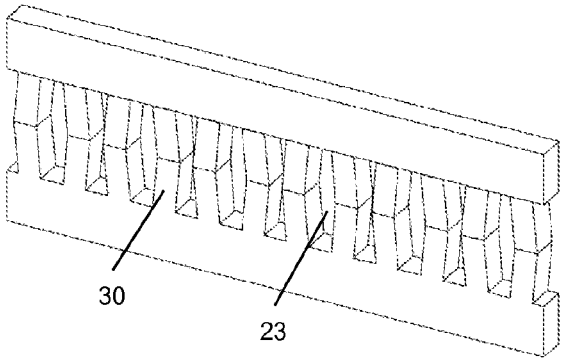
Figure 12C:
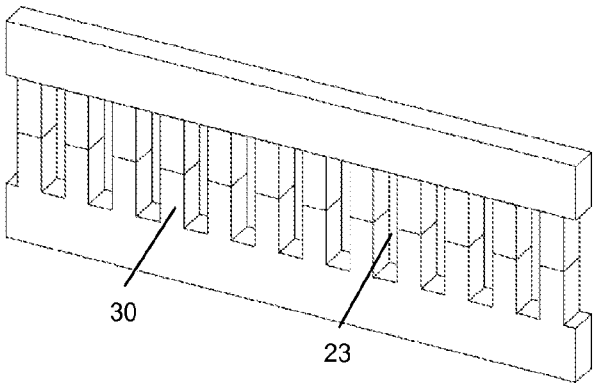
Figure 12D:
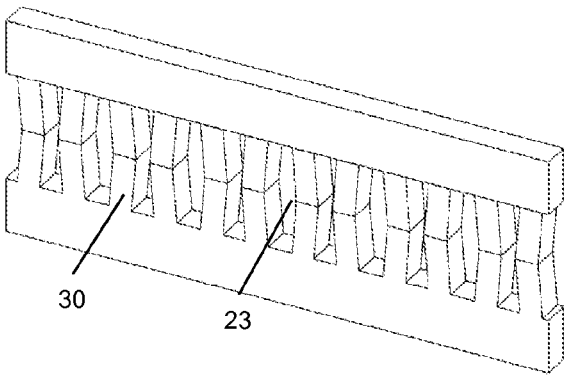

In one embodiment, the parallel pumping channels 23 of the pump 22 of FIG. 10 can be implemented in a piezo channel array, in which the shared walls of adjacent channels are provided by shear mode walls of the piezo channel array, as shown in FIGS. 12A-12D. Here, alternate walls are actuated by the controller 29 in a two-phase mode, such that every second channels is in the same phase and the channels between them are also in phase, but 180° out of phase with adjacent channels. Thus, FIG. 12A shows the walls 30 between the channels 23 in their initial positions at a 0° phase angle. As shown in FIG. 12B, at 90° phase angle, the walls 30 have been moved alternately left or right to their furthest point of displacement in one direction, so as to expand and contract adjacent channels 23 to draw fluid into one set channels (A) and displace fluid out of the alternating set (B) of channels. FIG. 12C shows the walls 30 at the 180° phase angle, where the walls 30 are back in their initial positions, where the A set of channels 23 have begun to contract to displace fluid therefrom and the B set of channels 23 has begun to expand to draw fluid in, and FIG. 12D shows the walls 30 at the 270° phase angle, where the walls 30 are at their furthest point of displacement in the other direction, so that the A set of channels 23 have fully contracted to displace fluid therefrom and the B set of channels 23 has fully expanded to draw fluid in.

Figure 13A:
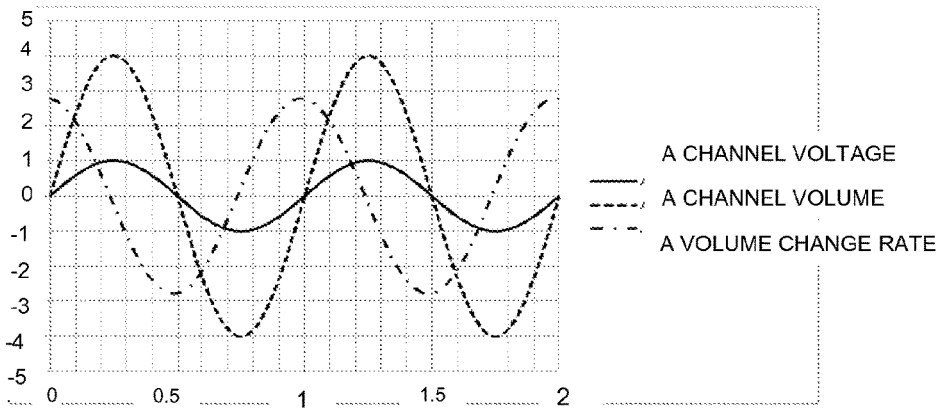
FIGS. 13A-B show channel voltages and volumes for the multi-chamber pump of FIG. 10 operating with a two-phase actuation with sinusoidal actuation.
Figure 13B:
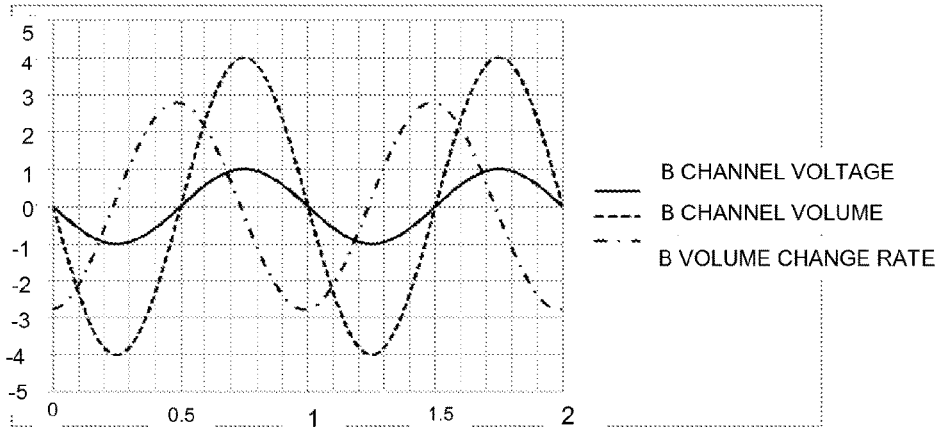
Figure 14A:
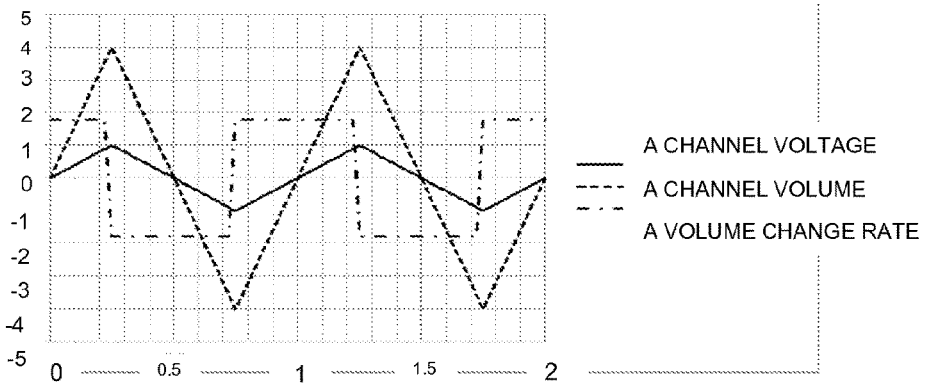
FIGS. 14A-B show channel voltages and volumes for the multi-chamber pump of FIG. 10 operating with a two-phase actuation with triangular actuation.
Figure 14B:
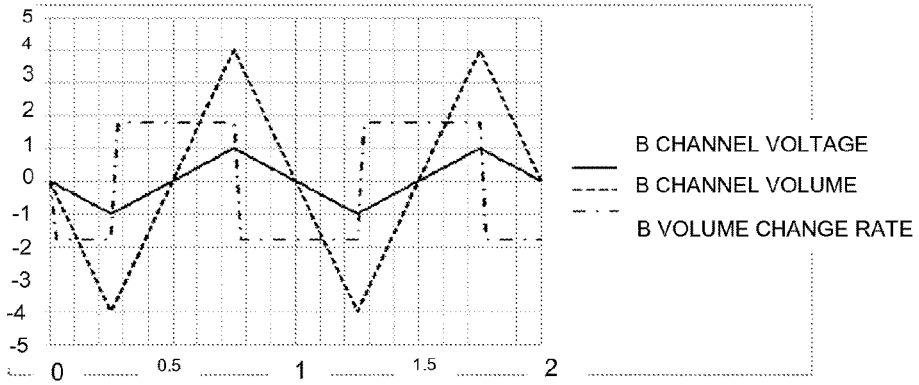
Figure 15A:
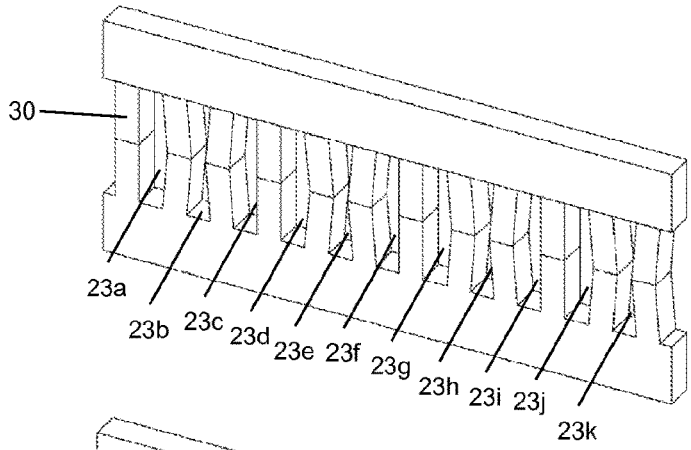
FIGS. 15A-D show part of a channel array of the multi-chamber pump of FIG. 10 operating with a three-phase actuation with the walls of the channels at zero, one-quarter, half and three-quarter phase positions.
Figure 15B:
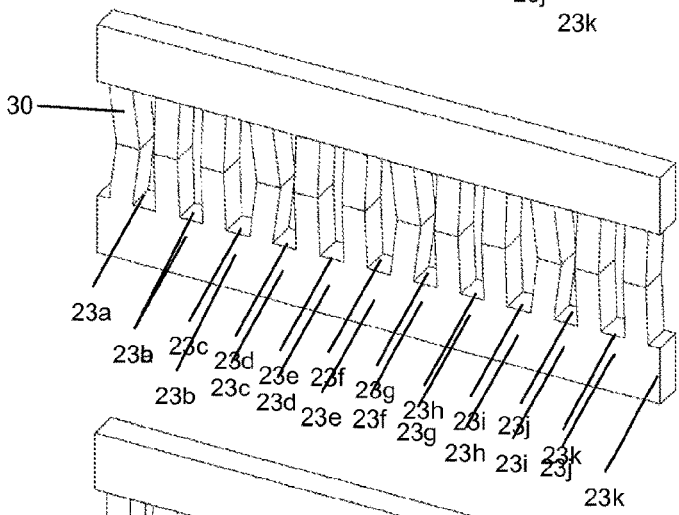
Figure 15C:
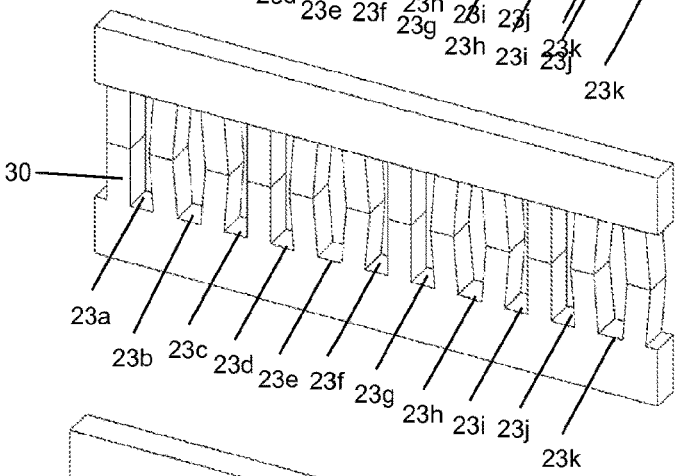
Figure 15D:
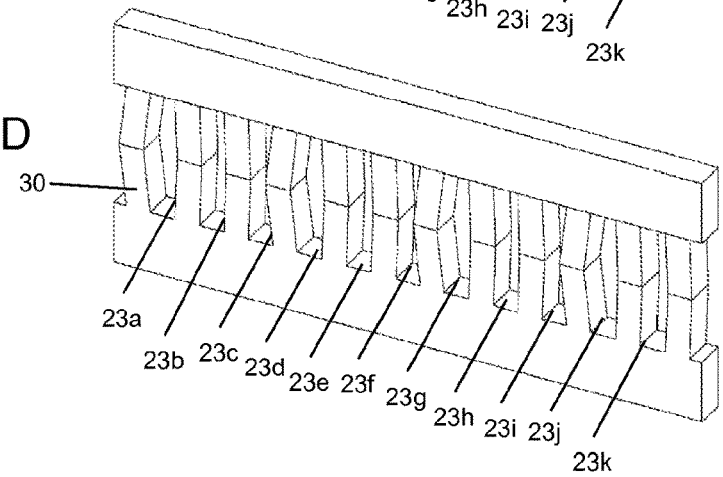

FIGS. 13 A and 13B show the channel voltage, volume, and volume change rate for the A set of channels, and the B set of channels, respectively, for a sinusoidal waveform applied to control the walls 30. It will be appreciated that the inlet flow rates, the outlet flow rates and the total flow rate for this pump with the sinusoidal applied waveform will be the same as those shown in FIGS. 5A, 5B and 5C for the dual-channel pump, and the external static pressure will be same as that shown in FIG. 6. Thus, although static pressure changes in the external circuit have been eliminated by making the volumetric changes from the neighbouring channels add together to give a total of zero volumetric change at any given point in time, nevertheless, the total output flow still varies considerably through time (as shown in FIG. 5C). A constant flow rate through the external circuit can be achieved by arranging that the total of the flow rates through all the channels added together is constant. This is most easily achieved if the flow rate through each individual channel is either constant or zero.

This can be achieved by using a triangular or trapezoidal control waveform for controlling actuation of the walls. For example, if the applied control waveform is a triangular waveform, FIGS. HA and 14B show the channel voltage, volume, and volume change rate for the A set of channels, and the B set of channels, respectively. Again, the inlet flow rates, the outlet flow rates and the total flow rate for this pump with the triangular applied waveform will be the same as those shown in FIGS. 8A, 8B and 8C for the dual-channel pump, and the external static pressure will be same as that shown in FIG. 9.

Of course, the pump of FIG. 10 need not be controlled in a two-phase mode, but could be driven in other phases, such as a three-phase mode. FIGS. 15A-15D show the shared walls of adjacent channels 23 provided by shear mode walls 30 of the piezo channel array, similar to that of FIGS. 12A-12D, but driven in a three-phase mode. In this case, instead of every second channel being in phase (as in the previous example), every third channel is in phase. FIGS. 15A-15D show eleven channels 23*a*-23*k*. Assuming that a fully expanded channel has a volume of "1" and a fully contracted channel has a volume of "0", the channels change volumes over the four phase angles 0°, 90°, 180°, and 270° approximately as shown in FIGS. 15A-15D as follows:

| | Channels | | | | | | | | | | |
|---|---|---|---|---|---|---|---|---|---|---|---|
| | 23a | 23b | 23c | 23d | 23e | 23f | 23g | 23h | 23i | 23j | 23k |
| 15A | ¼ | 0 | ¼ | ¼ | 0 | ¼ | ¼ | 0 | ¼ | ¼ | 0 |
| 15B | ¼ | ½ | ¼ | ¼ | ½ | ¼ | ¼ | ½ | ¼ | ¼ | ½ |
| 15C | ¼ | 1 | ¼ | ¼ | 1 | ¼ | ¼ | 1 | ¼ | ¼ | 1 |
| 15d | ¼ | ½ | ¼ | ¼ | ½ | ¼ | ¼ | ½ | ¼ | ¼ | ½ |

Figure 16A:
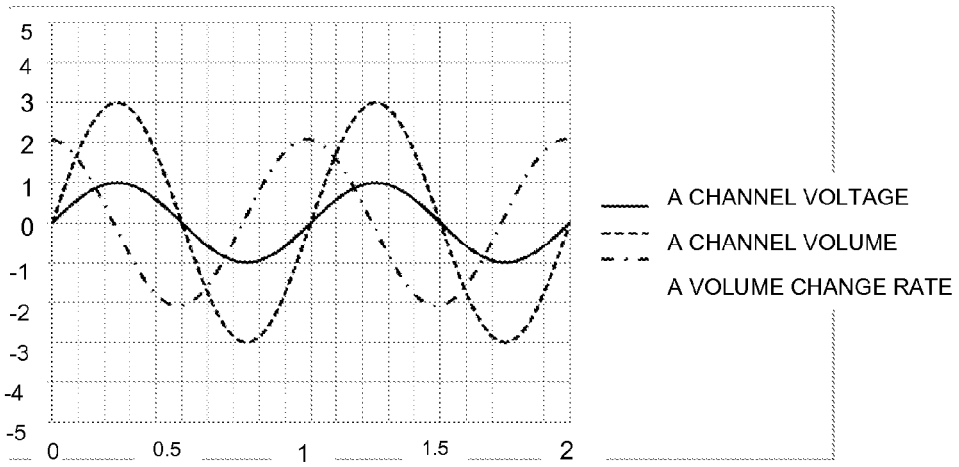
FIGS. 16A-C show channel voltages and volumes for the multi-chamber pump of FIG. 10 operating with a three-phase actuation with sinusoidal actuation.
Figure 16B:
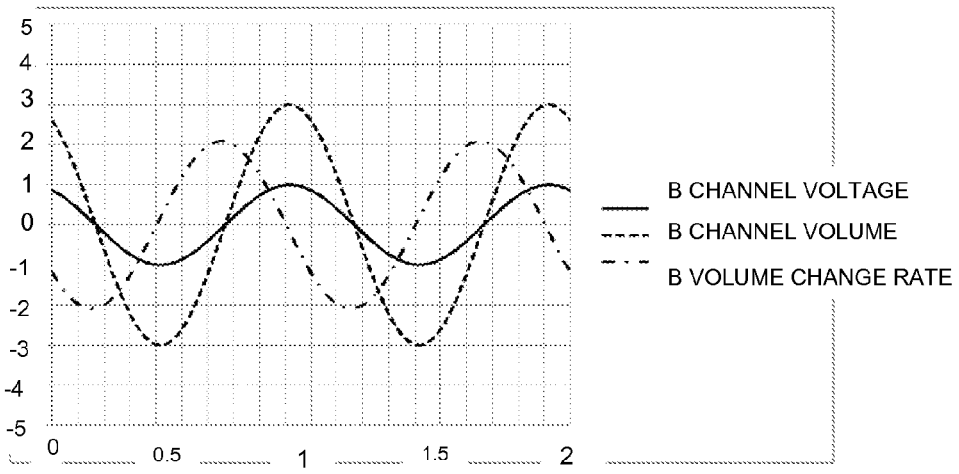
Figure 16C:
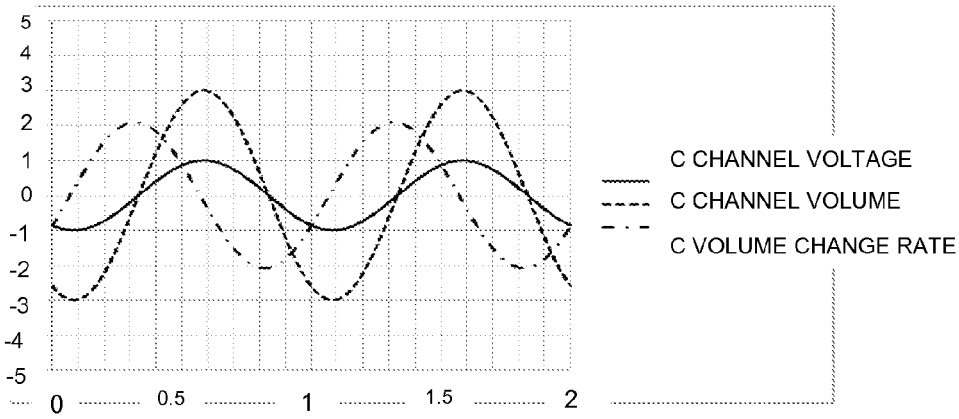
Figure 17A:
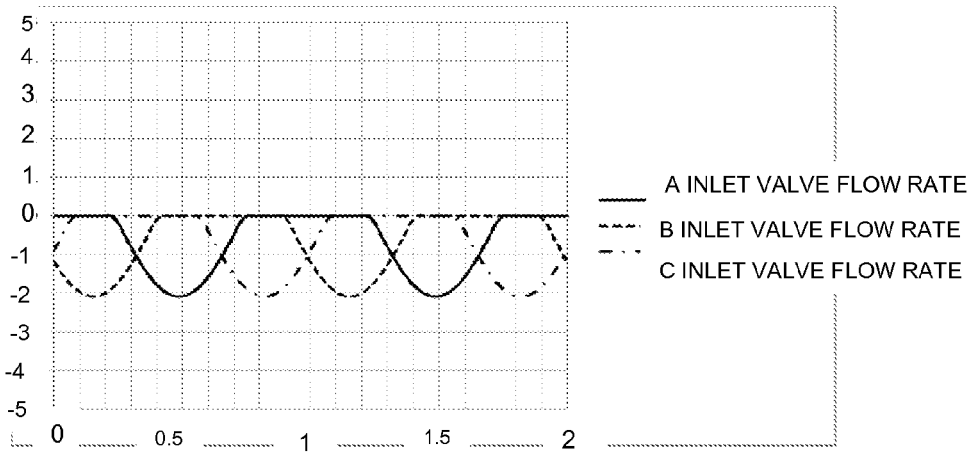
FIGS. 17A-C show inlet, outlet and total flow rates for the multi-chamber of FIG. 10 operating with a three-phase actuation with sinusoidal actuation.
Figure 17B:
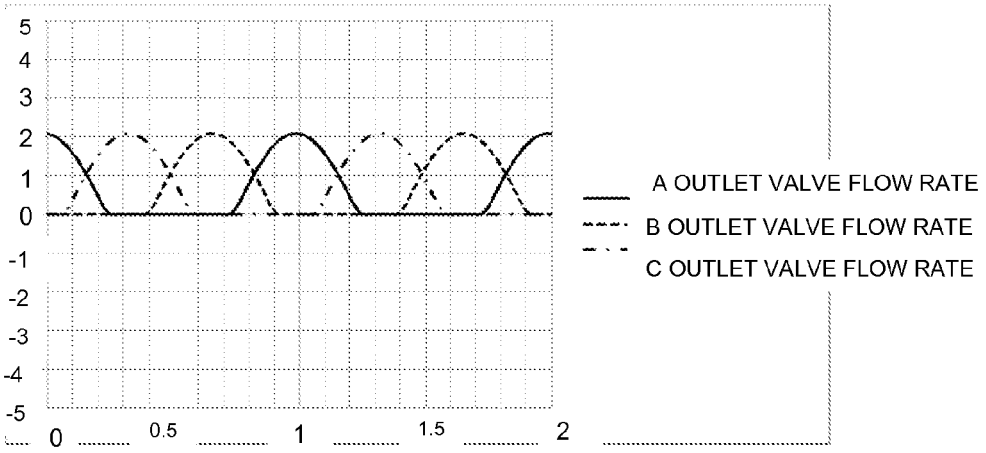
Figure 17C:
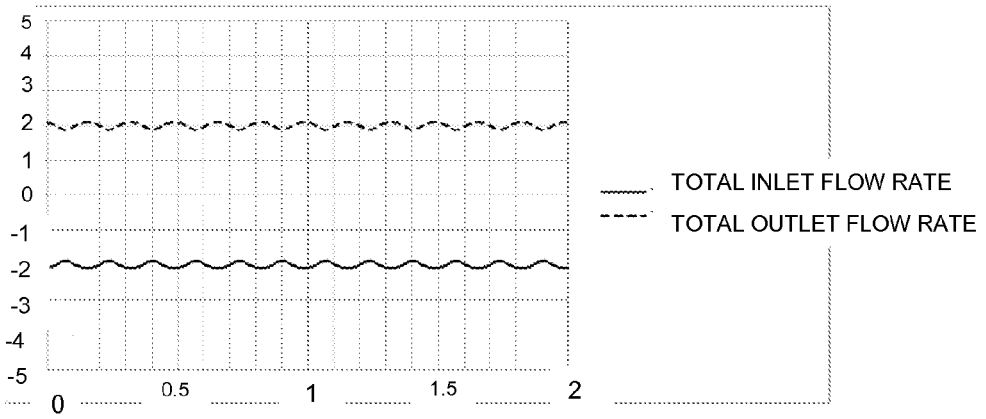

FIGS. 16A-16C show the channel voltage, volume, and volume change rate for a first (A) set of channels, a second (B) set of channels, and a third (C) set of channels, respectively, for a sinusoidal control waveform. As can be seen, although the graphs of FIGS. 16A-16D are offset in phase angle compared to FIGS. 15A-15D, set A corresponds, essentially, to channels 23*b*, 23*e*, 23*h* and 23*k*; set B corresponds to channels 23*c*, 23*f*, and 23*i*; and set C corresponds to channels 23*a*, 23*d*, 23*g*, and 23*j*. FIGS. 17A and 17B show the individual inlet and outlet flow rates for sets A, B and C, and FIG. 17C shows the total inlet and outlet flow rates, from which it can be seen that, although not constant, the three-phase mode provides far less variability in the total inlet and outlet flow rates that when the pump is controlled in the two-phase mode.

Figure 18A:
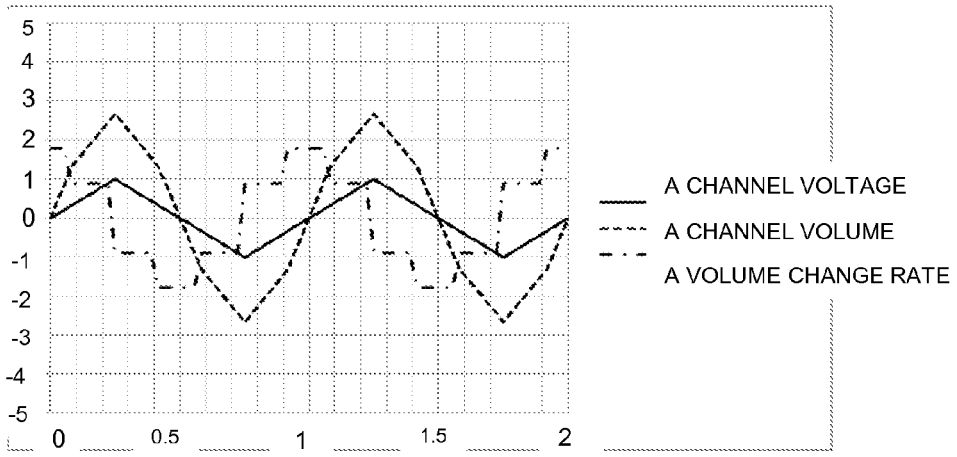
FIGS. 18A-C show channel voltages and volumes for the multi-chamber pump of FIG. 10 operating with a three-phase actuation with triangular actuation.
Figure 18B:
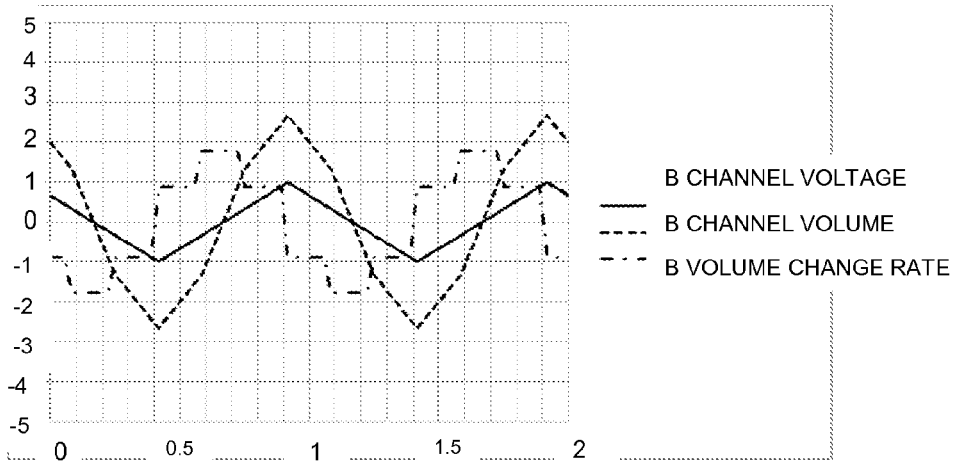
Figure 18C:
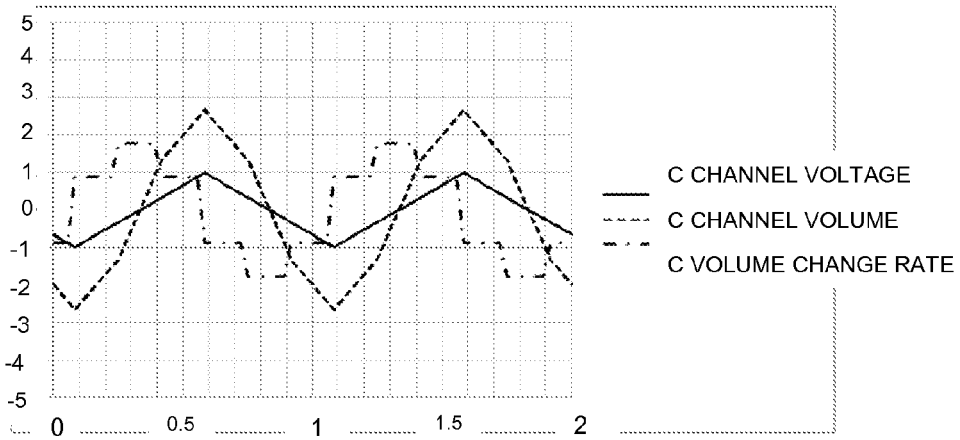
Figure 19A:
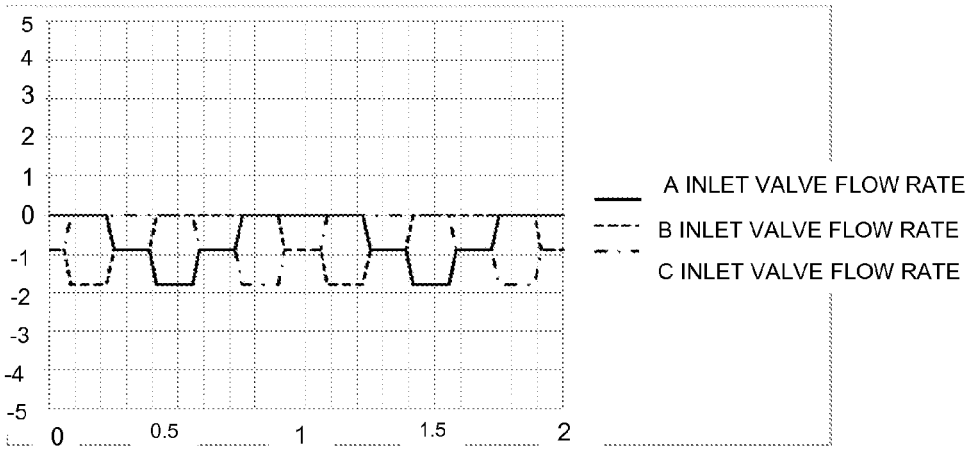
FIGS. 19A-C show inlet, outlet and total flow rates for the multi-chamber pump of FIG. 10 operating with a three-phase actuation with triangular actuation.
Figure 19B:
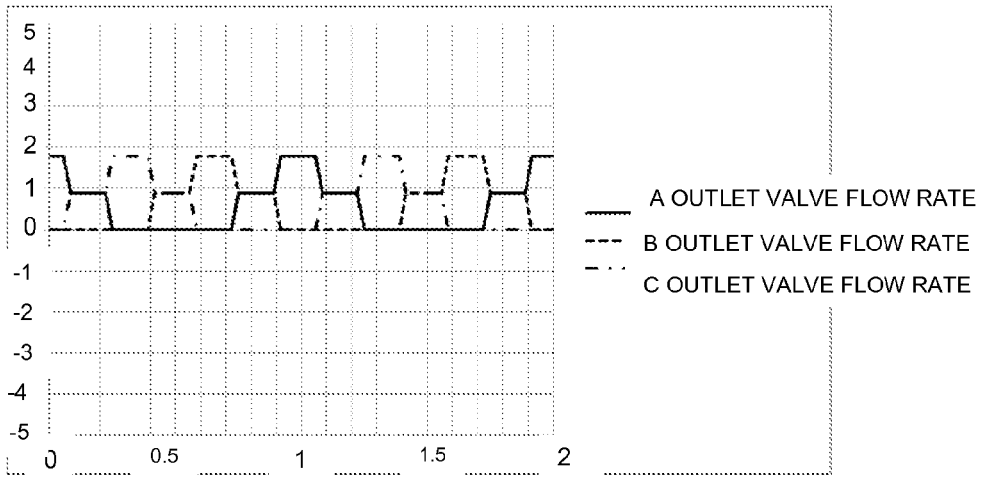
Figure 19C:
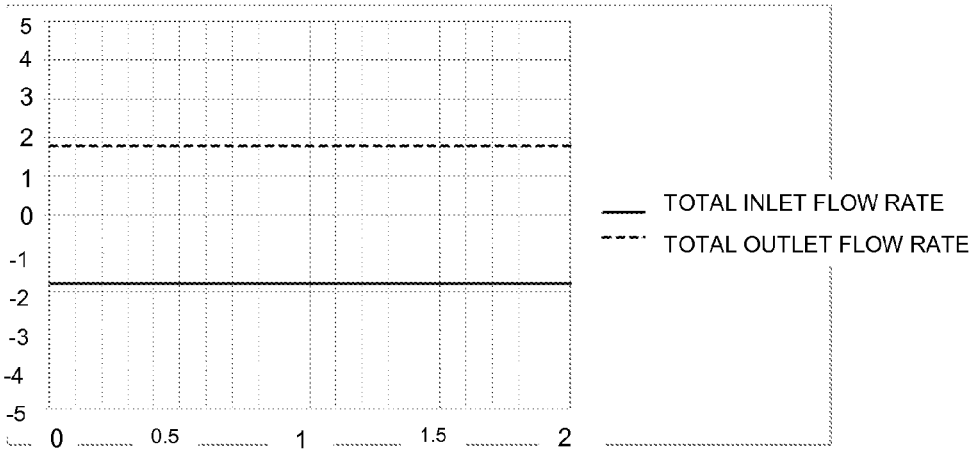

FIGS. 18A-18C show the channel voltage, volume, and volume change rate for the first (A) set of channels, the second (B) set of channels, and the third (C) set of channels, respectively, for a triangular control waveform. FIGS. 19A and 19B show the individual inlet and outlet flow rates for sets A, B and C, and FIG. 19C shows the total inlet and outlet flow rates, from which it can be seen that even the reduced variability in total inlet and outlet flow rates provided in the three-phase sinusoidal control has been removed when a three-phase triangular waveform is used to control the movement of the walls.

Figure 20A:
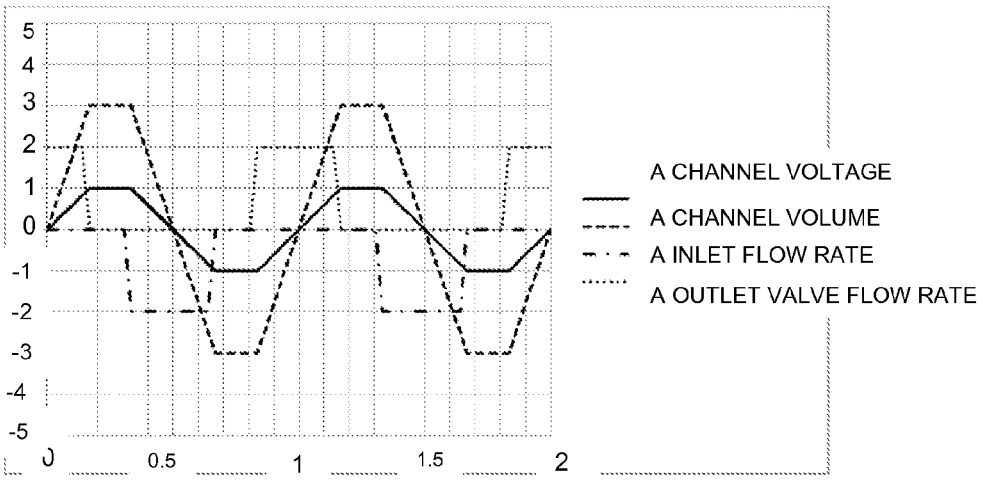
FIGS. 20A-C show channel voltages and volumes for the multi-chamber pump of FIG. 10 operating with a three-phase actuation with trapezoidal actuation.
Figure 20B:
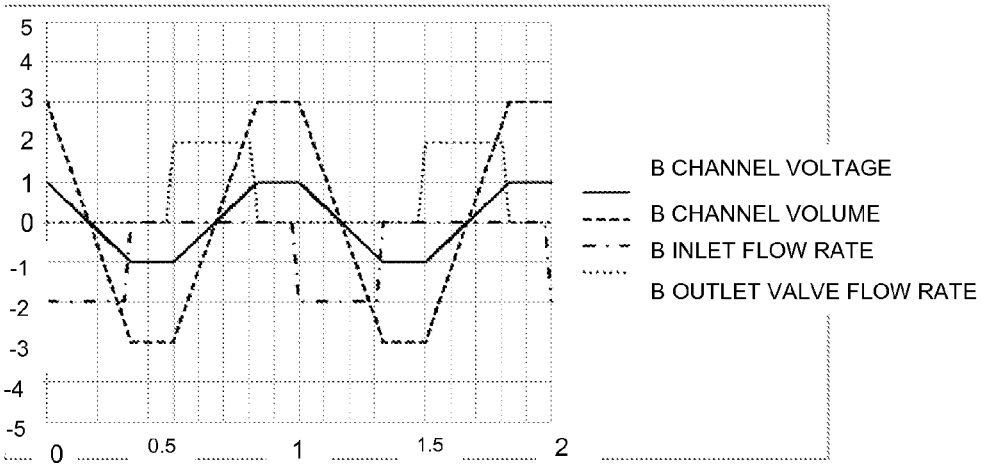
Figure 20C:
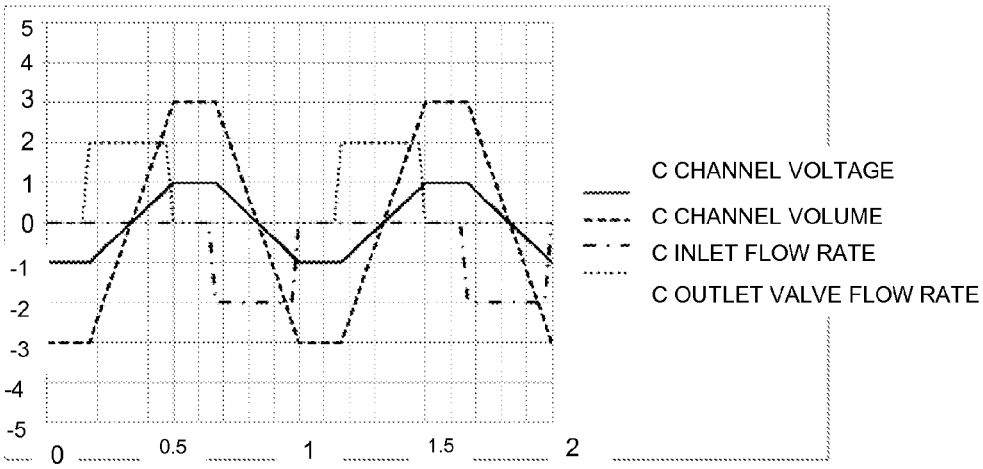
Figure 21A:
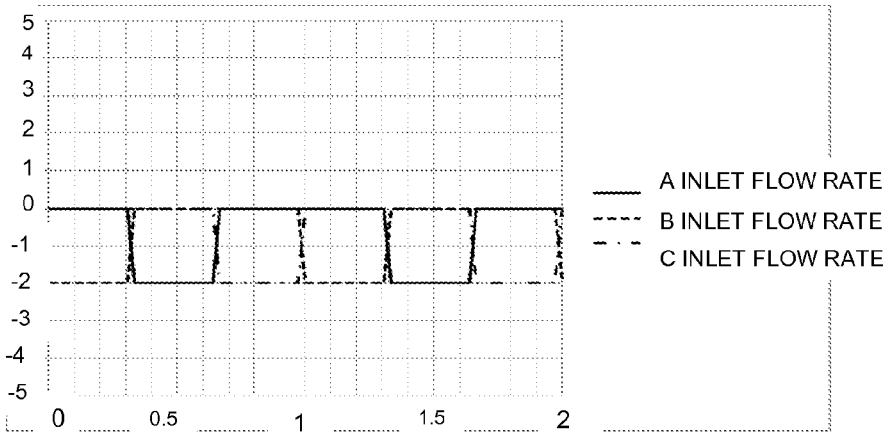
FIGS. 21A-C show inlet, outlet and total flow rates for the multi-chamber pump of FIG. 10 operating with a three-phase actuation with trapezoidal actuation.
Figure 21B:
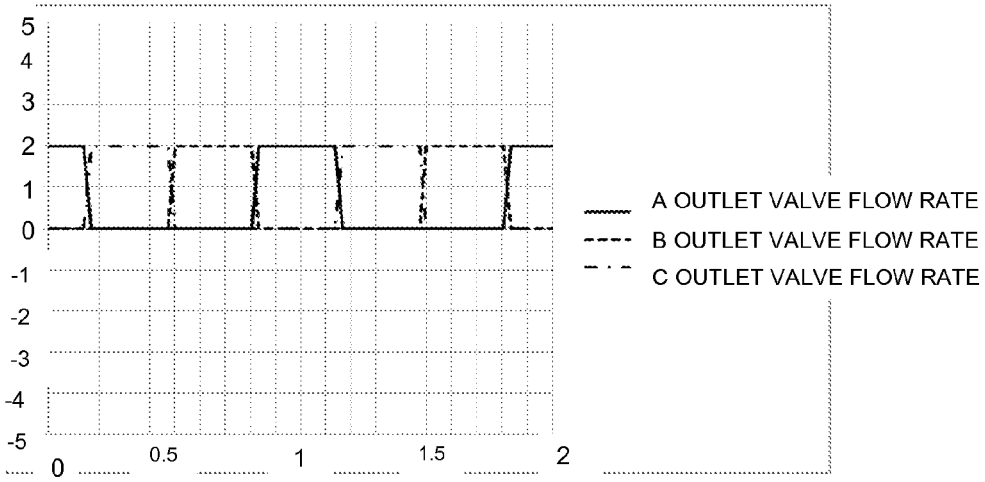
Figure 21C:
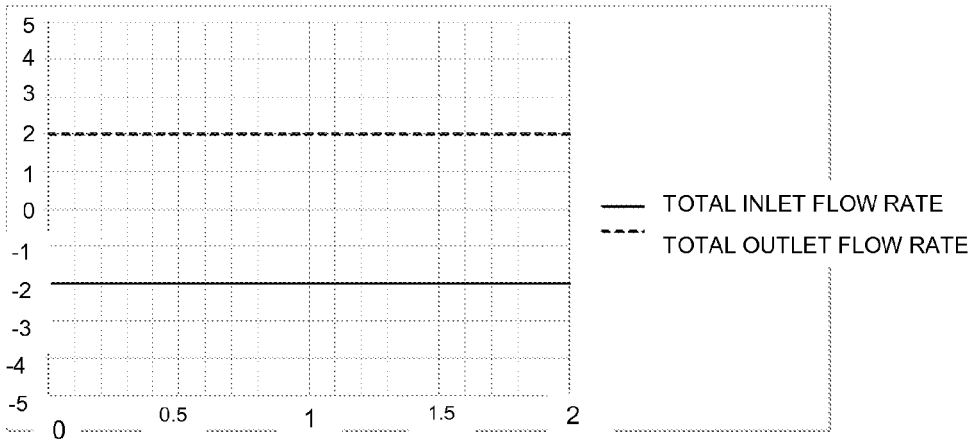

FIGS. 20A-20C show the channel voltage, volume, the inlet flow rate, and the outlet flow rate for the first (A) set of channels, the second (B) set of channels, and the third (C) set of channels, respectively, for a trapezoidal control waveform. FIGS. 21A and 21B show the individual inlet and outlet flow rates for sets A, B and C, and FIG. 21C shows the total inlet and outlet flow rate, which also shows that the total inlet and outlet flow rates are constant, when a three-phase trapezoidal waveform is used to control the movement of the walls.

Figure 22A:
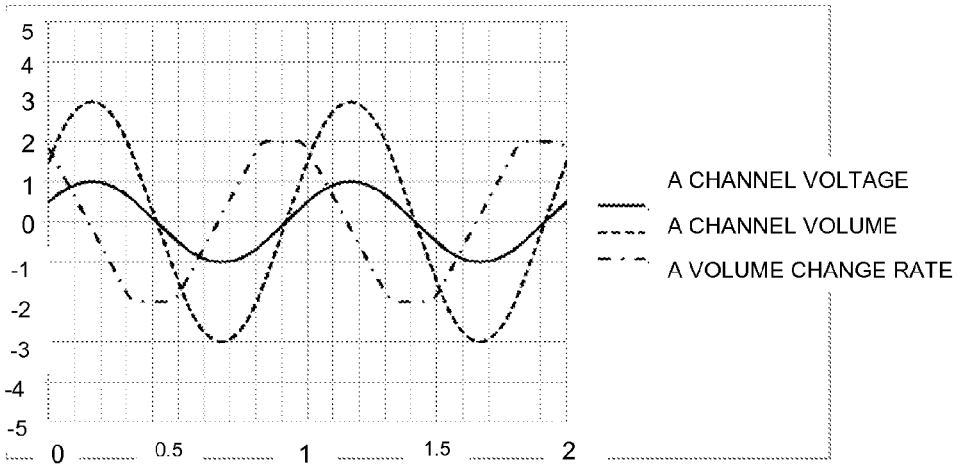
FIGS. 22A-C show channel voltages and volumes for the multi-chamber pump of FIG. 10 operating with a three-phase actuation with parabolic actuation.
Figure 22B:
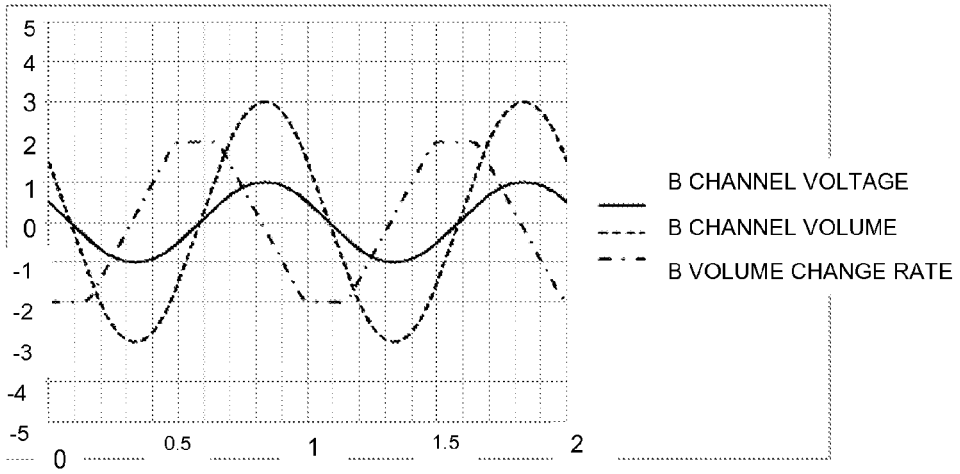
Figure 22C:
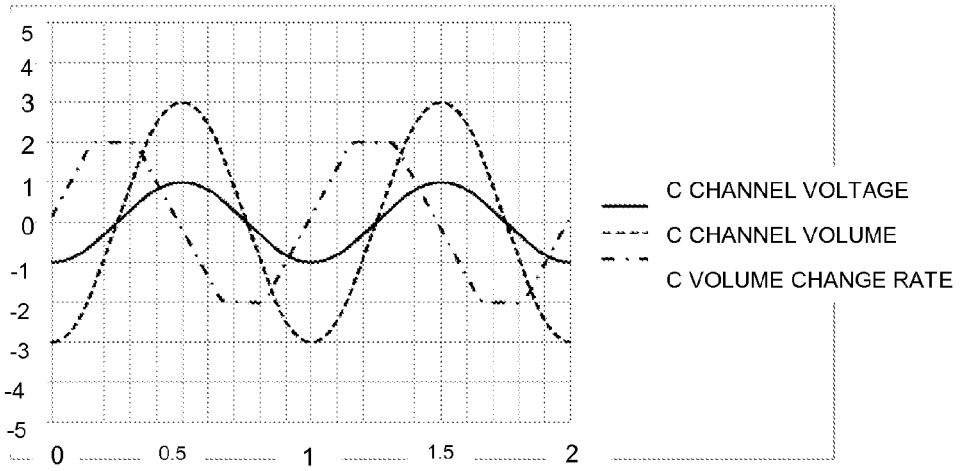
Figure 23A:
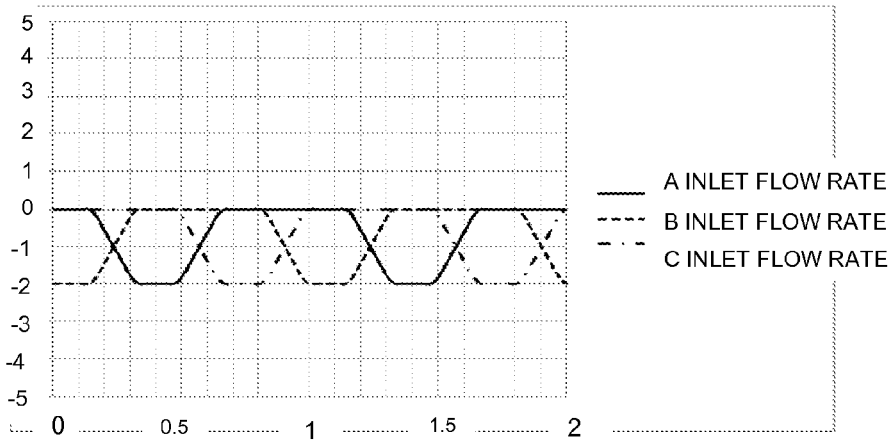
FIGS. 23A-C show inlet, outlet and total flow rates for the multi-chamber pump of FIG. 10 operating with a three-phase actuation with parabolic actuation.
Figure 23B:
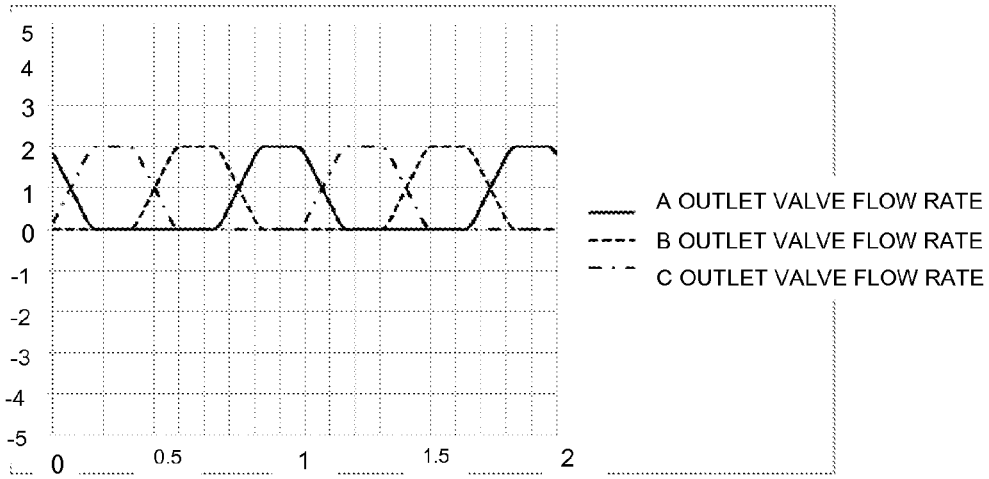
Figure 23C:
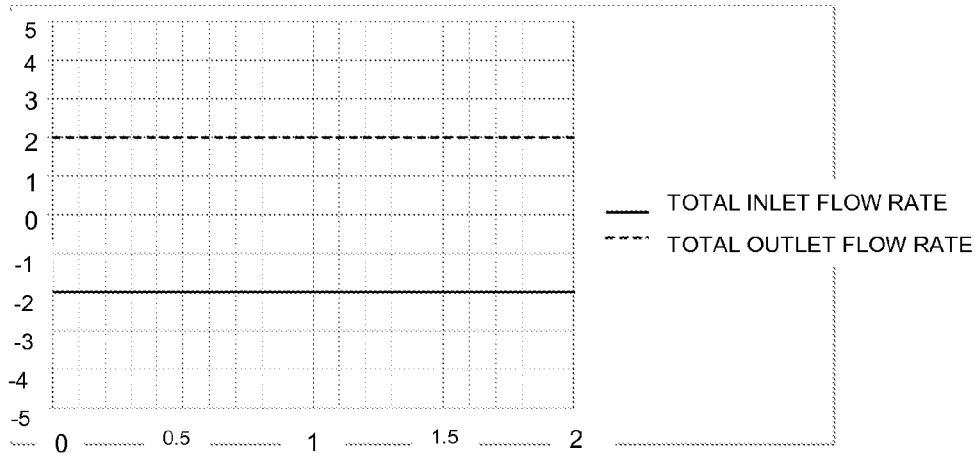
Figure 24A:
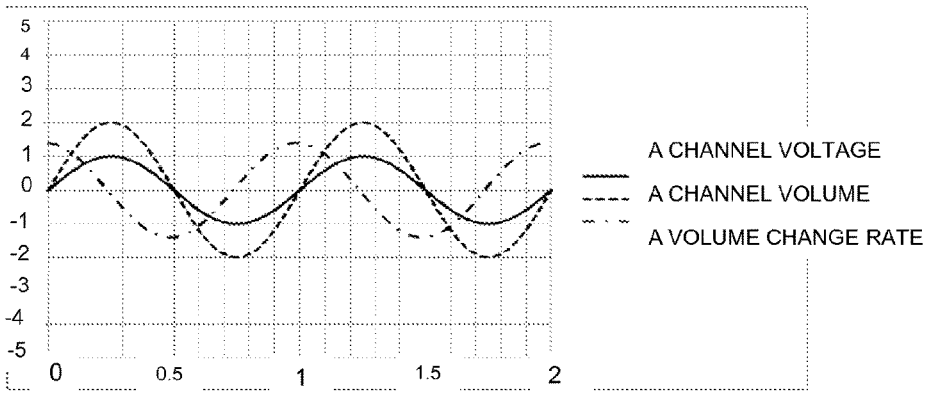
FIGS. 24 A-D show channel voltages and volumes for the multi-chamber pump of FIG. 10 operating with a four-phase actuation with sinusoidal actuation.
Figure 24B:
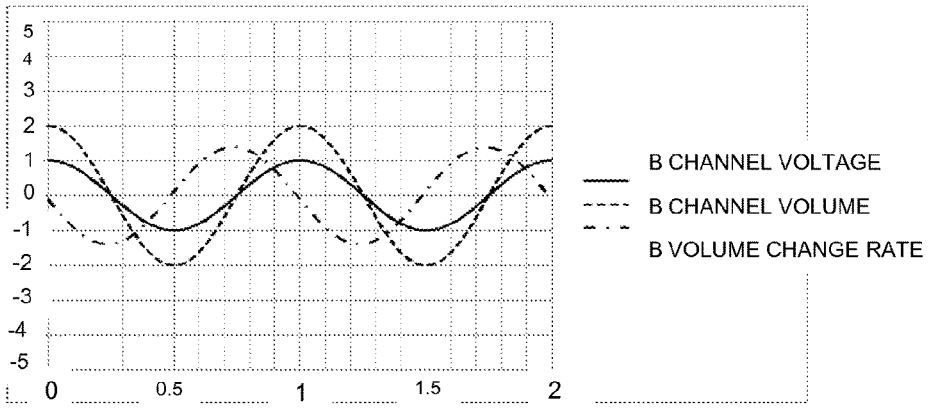
Figure 24C:
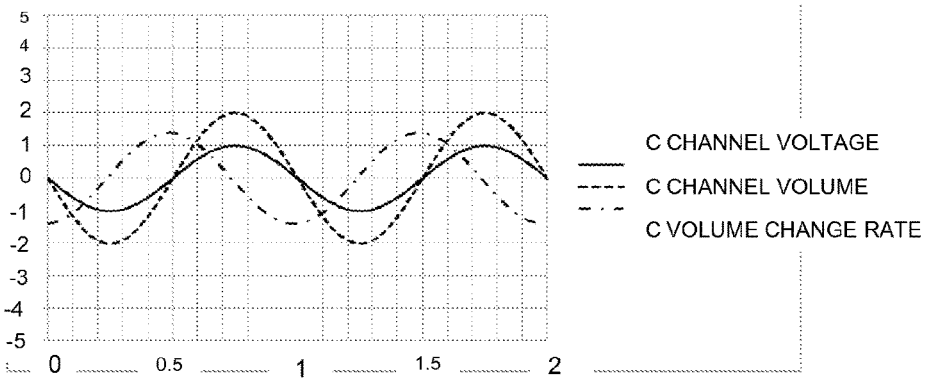
Figure 24D:
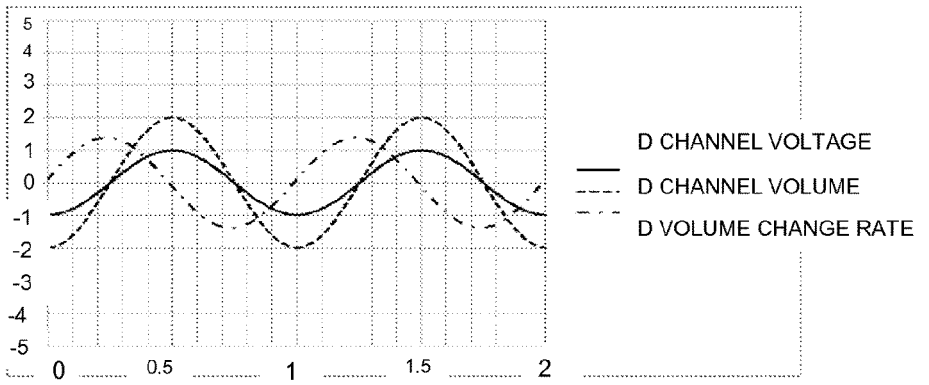

FIGS. 22A-22C show the channel voltage, volume, and volume change rate for the first (A) set of channels, the second (B) set of channels, and the third (C) set of channels, respectively, for a parabolic control waveform. FIGS. 23A and 23B show the individual inlet and outlet flow rates for sets A, B and C, and FIG. 23C shows the total inlet and outlet flow rate, which also shows that the total inlet and outlet flows are constant, when a three-phase parabolic waveform is used to control the movement of the walls.

Figure 25A:
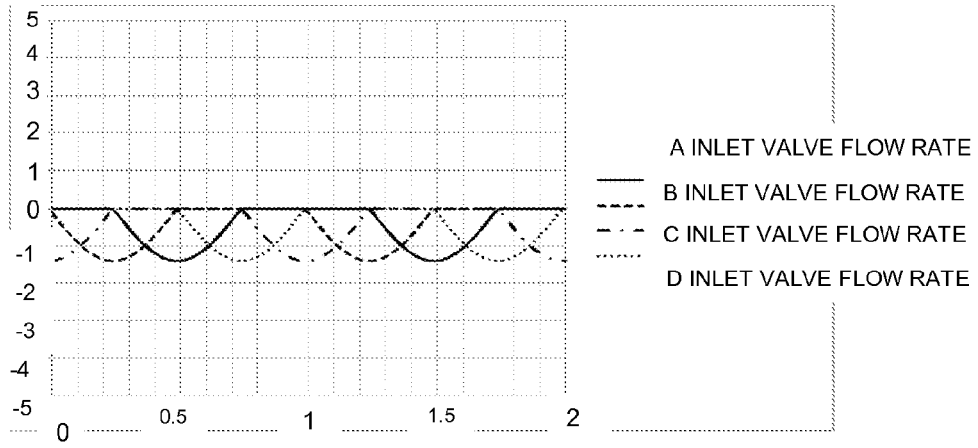
FIGS. 25A-C show inlet, outlet and total flow rates for the multi-chamber of FIG. 10 operating with a four-phase actuation with sinusoidal actuation.
Figure 25B:
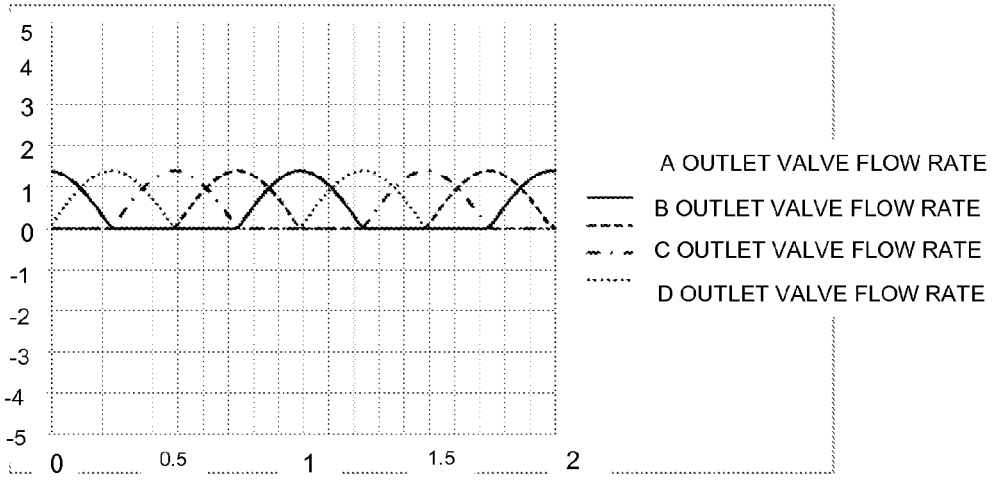
Figure 25C:
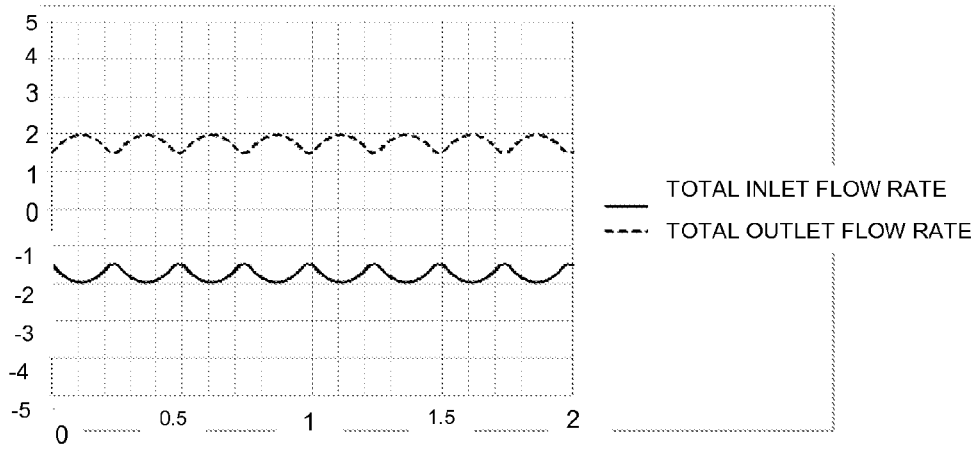
Figure 26A:
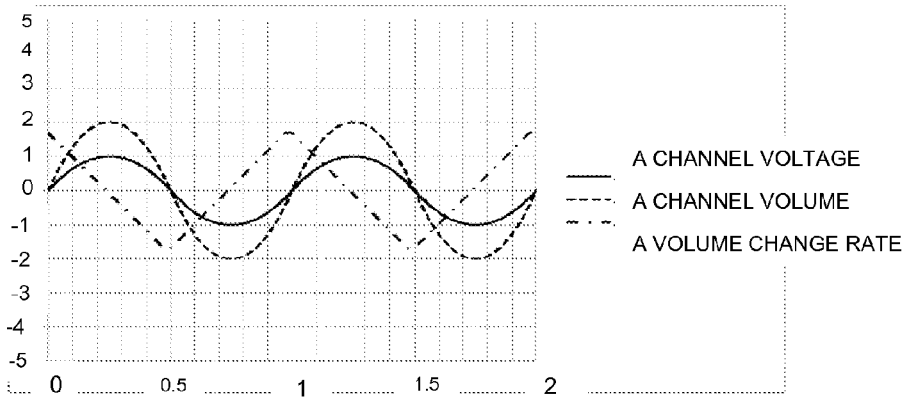
FIGS. 26A-D show channel voltages and volumes for the multi-chamber pump of FIG. 10 operating with a four-phase actuation with parabolic actuation.
Figure 26B:
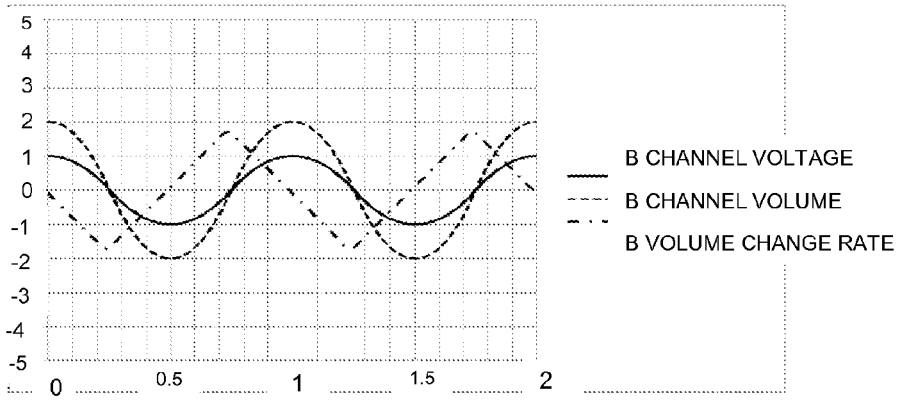
Figure 26C:
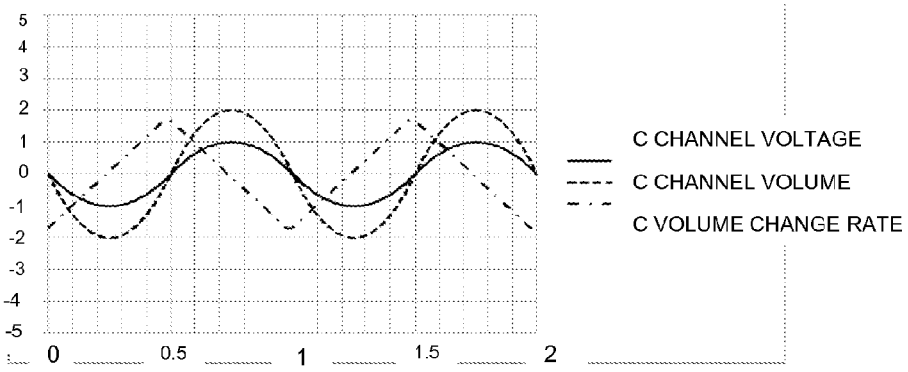
Figure 26D:
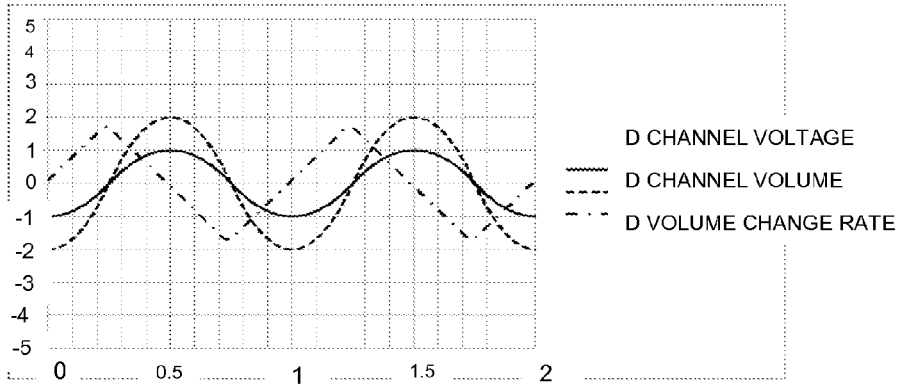

FIGS. 24A-24D show the channel voltage, volume, and volume change rate for the first (A) set of channels, the second (B) set of channels, the third (C) set of channels, and a fourth (D) set of channels, respectively, for a four-phase mode of control of the actuation of the walls using a sinusoidal control waveform. FIGS. 25A and 25B show the individual inlet and outlet flow rates for sets A, B, C and D, and FIG. 25C shows the total inlet and outlet flow rate, which again shows that although not constant, the four-phase mode provides far less variability in the total inlet and outlet flow rates that when the pump is controlled in the two-phase mode, although there is more variability than in the three-phase mode of operation with a sinusoidal control waveform.

It will be appreciated that triangular and trapezoidal control waveform actuation in four-phase mode will correspond to that of triangular and trapezoidal control waveform actuation in three-phase mode and will provide essentially constant total flow rates at the inlet and outlet.

Figure 27A:
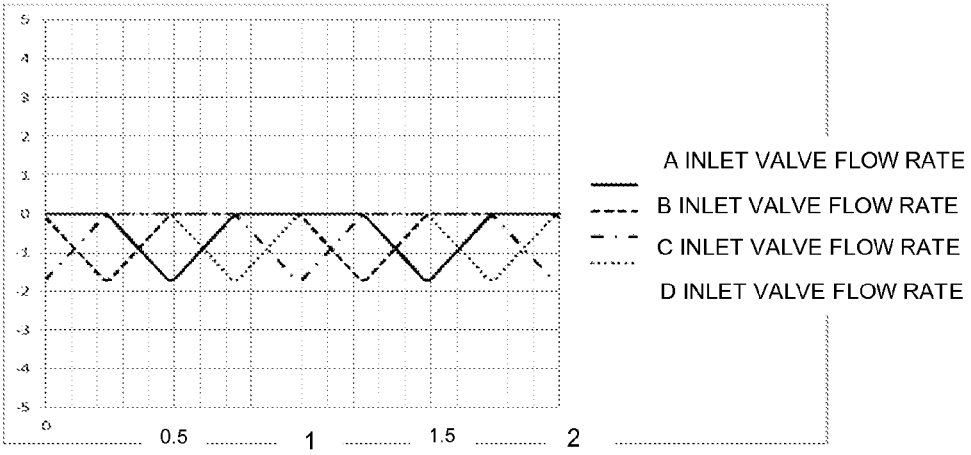
FIGS. 27A-C show inlet, outlet and total flow rates for the the multi-chamber of FIG. 10 operating with a four-phase actuation with parabolic actuation.
Figure 27B:
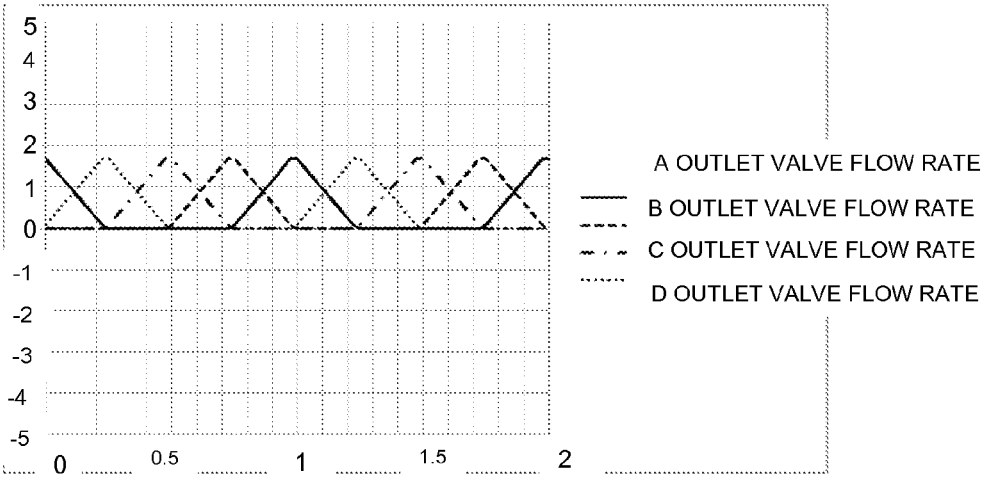
Figure 27C:
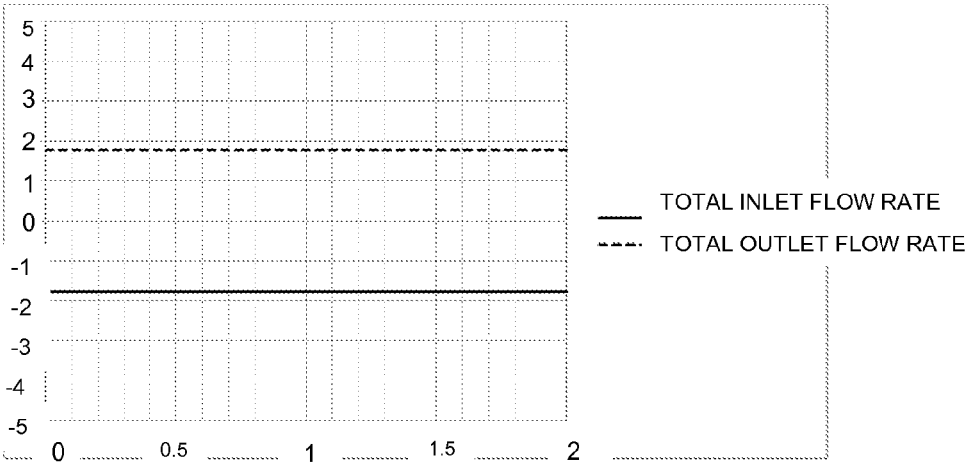

FIGS. 26A-26D show the channel voltage, volume, and volume change rate for the first (A) set of channels, the second (B) set of channels, the third (C) set of channels, and the fourth (D) set of channels, respectively, for a four-phase mode of control of the actuation of the walls using a parabolic control waveform. FIGS. 27A and 27B show the individual inlet and outlet flow rates for sets A, B, C and D, and FIG. 27C shows the total inlet and outlet flow rate, which again shows that the total inlet and outlet flows are constant, when a four-phase parabolic waveform is used to control the movement of the walls.

Returning, now to FIG. 7, it was mentioned that the non-return valves of FIG. 4 had been replaced by fluidic diodes. Generally, fluidic diodes are non-return valves that have no moving parts and are manufactured in silicon using micro machining processes, to form Micro Electrical Mechanical Systems (MEMS). They often comprise a plurality of topological micromixers that split, turn, and recombine the fluid arranged in series in the fluidic diode. There are a number of such fluidic diodes available.

Figure 28A:
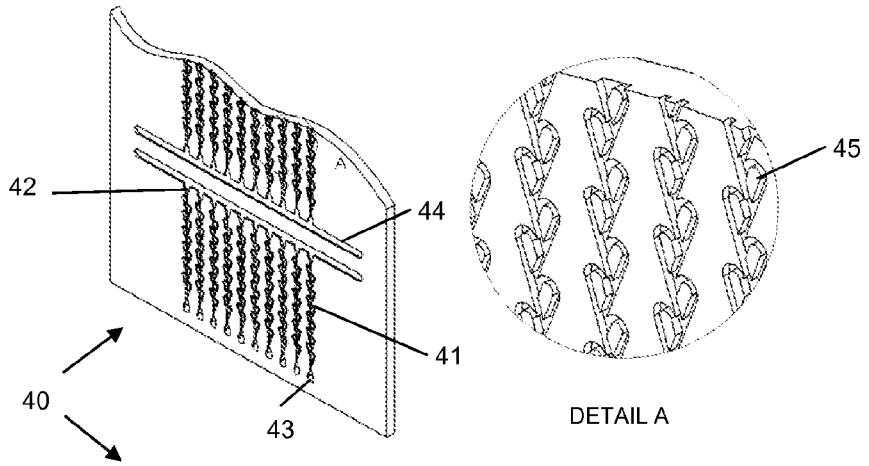
FIGS. 28A-B show schematic isometric and plan views of a Tesla diode array that may be used in the pump of FIG. 10.
Figure 28B:
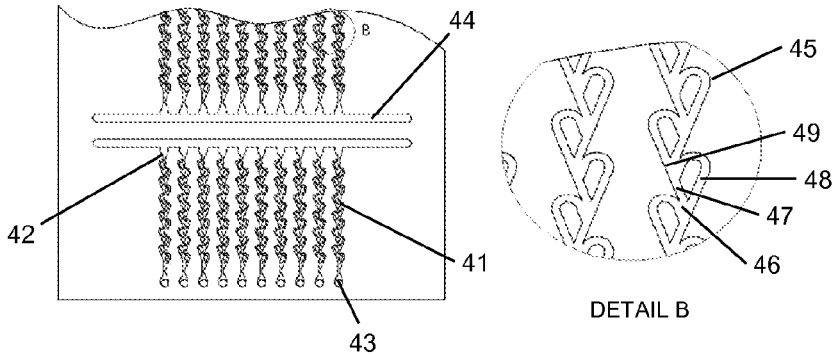

One known fluidic diode is a so-called Tesla valvular conduit, as shown in FIGS. 28A and 28B. As can be seen, a silicon substrate 40 is machined, for example using a MEMS process known as Deep Reactive Ion Etching (DRIE), with a number of parallel channels 41, each extending between an inlet 42 and an outlet 43. In this embodiment, the inlets 42 are all connected to a common inlet 44. Each of the channels 41 is formed by a plurality of Tesla structures 45. Each Tesla structure 45 has a first port 46 which splits into two pathways 47 and 48. A first of the pathways 47 provides a direct connection to a second port 49 of the structure 45. A second of the pathways 48 diverges from the first pathway 47 and curves around so that it connects to the second port 49 from a direction that is greater than orthogonal to the first pathway 47.

Therefore, when fluid moves from the first port 46 to the second port 49, it is split when it enters the first port 46 into the first pathway 47 and the second pathway 48. The fluid in the first pathway 47 moves directly towards the second port 49, but the fluid in the second pathway 48 moves through the second pathway to end up at the second port 49 moving at a substantial angle to the fluid approaching the second port 49 from the first pathway 47. Hence the fluids from the two pathways mix just before reaching the second port 49 and the fluid from the second pathway 48 provides resistance to the fluid from the first pathway 47 exiting the second port 49. By having a plurality of such Tesla structures in series, substantial resistance to fluid moving from the first port of the first of the structures in the series to the second port of the final structure in the series is achieved. On the other hand, if fluid is moving from the second port 49 to the first port 46, very little fluid will move into the second pathway 49, since it is angling back on the direction of movement of the fluid, so that most fluid will pass straight through the first pathway 47 to the first port 46. Hence, the structure 45 provides very little resistance to the fluid moving from the second port 49 towards the first port 46, but considerable resistance to fluid moving in the other direction.

Figure 29A:
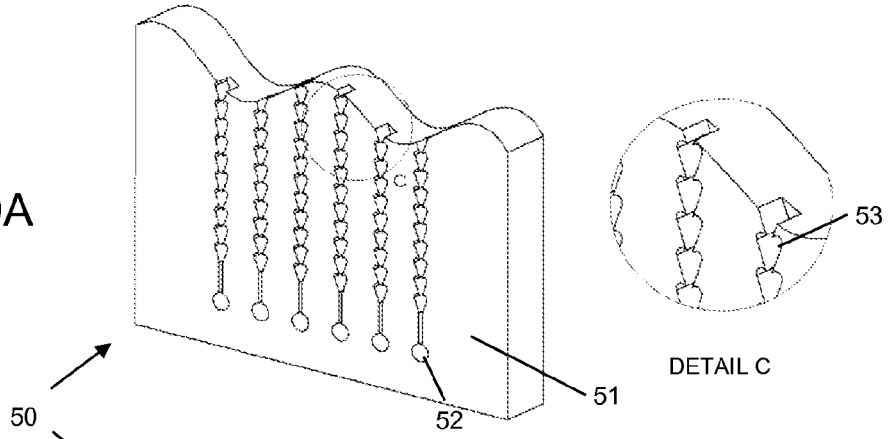
FIGS. 29A-B show schematic isometric and plan views of a nozzle diffuser fluidic diode array that may be used in the pump of FIG. 10.
Figure 29B:
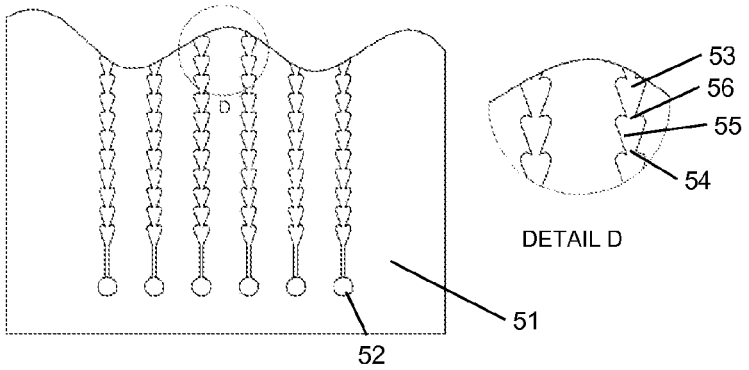

Another known fluidic diode is a nozzle diffuser structure, as shown in FIGS. 29A and 29B. Again, a silicon substrate 50 is machined, for example using the DRIE process, with a number of parallel channels 51, each extending between an inlet 52 and an outlet (not shown). Each of the channels 51 is formed by a plurality of nozzle diffuser structures 53. Each nozzle diffuser structure 53 has a narrow first port 54 which acts as a nozzle into a chamber 55, which has curved sides which diverge from the nozzle outwardly and then curve back towards each other at a second port 56. Therefore, when fluid moves from the first port 54 into the chamber 55, the fluid forms eddies in regions close to abrupt changes in section, causing the flow-rate to be substantially lower in that direction of fluid motion than in the other direction for a given pressure differential across the diode structure.

Another known fluidic diode is a vortex diode, as shown in FIGS. 30A and 30B. Again, a silicon substrate 60 is machined with a number of parallel channels 61, each extending between an inlet 62 and an outlet (not shown). Each of the channels 61 is formed by a plurality of vortex diode structures 63. Each vortex structure 63 is formed by an axial port 64 connected to a tangential port 65. Here, the resistance to flow is higher in one direction than the other because, when the flow enters the axial port 64, the flow can move readily to the tangential port 65, whereas when it enters the tangential port 65, a circulating flow is produced that produces a radial pressure that acts to reduce the rate of flow to the axial port 64.

The Tesla Valvular Conduit, the Nozzle Diffuser and Vortex Diode structures can all be built in silicon using the DRIE process, because the structures are extruded projections of two-dimensional geometries and this process is well-suited to the manufacture of such structures. However, the process is quite costly. For more economical manufacture of large numbers of fluidic diodes, it would be possible to use the DRIE process to produce a master component and to use that to produce an impression for use in a moulding or embossing tool. Thus multiple, cheap copies of the original silicon diodes could be made cheaply in suitable plastics materials.

As mentioned above, one suitable form of actuating element that can be used to cause the fluid to move through the channels is a piezo channel array. Such actuators can be easily be integrated with the fluidic diodes described above to cause the fluid to move through the channels. However other actuating elements could alternatively be used. Diaphragms or walls that flex in response to applied voltages via electrostatic actuation can be made from materials including, but not limited to, silicon or similar materials or polymeric sheets so as to displace volumes of fluid periodically. Silicon or similar materials can be made into diaphragms or walls that flex due to Joule heating and differential expansion effects, and that therefore displace volumes of fluid periodically. Electromagnetic actuation can be used to apply forces to diaphragms or walls causing them to flex and displace volumes of fluids periodically, by forming electrically conductive tracks in or on the flexing element and arranging for these to pass through a magnetic field. Alternatively, bubbles can be generated in some fluids, if they contain a volatile fraction, and these bubbles can be used to displace volumes of fluid periodically.

In general micro-pumps based on fluidic diodes will allow reversals of flow direction if the channels stop actuating. In some applications, this will not matter. In others it will. For those applications where reversed flows should be prevented, the addition of conventional non-return valves in series with the fluidic diodes will solve the problem. These valves may also be micro-fabricated in the structure, or may be standalone external devices. In the case of conventional non-return valves, as the frequency of the positive and negative pressures from the channels increases, the less efficiently the device works. This is because the valve does not have time either to open fully or to close fully above a certain frequency, resulting in heightened resistance to forward flow and limited resistance to reverse flow. However, conventional valves can resist reverse flows driven by external back-pressures even when the channels are not operating.

Hence, for many applications, it will be advantageous for fluidic diodes and conventional non-return valves to be employed to perform complementary functions, with the fluidic diodes converting the high frequency changes in volume in the channels to steady one-directional flow. Meanwhile, the conventional non-return valves allow the steady flow output from the fluidic diodes to pass with minimal resistance in the forward direction, but close completely in response to high upstream pressures that would otherwise cause reverse flows. The non-return valves can, for example, be in the form of reed, ball, diaphragm or poppet valves.

The non-return valves can perform two related, but different, functions in a micro-pump. Firstly, they can be used to prevent reverse flows if and when all the actuating channels are switched off, for instance in either the planned or unplanned event of power being removed from the whole micro-pump. Secondly, the presence of the non-return valves allows a method of controlling flow-rate from the micro-pump. As shown in FIG. 31, sub-sections 66 of the array of pumping elements can be working in parallel, with the non-return valves 67 allowing selected sub-sections 66 of the micro-pump to be switched off, whilst allowing other sub-sections 66 to continue to run. The non-return valves 67 prevent reverse flows from occurring in those parts of the pump where the channels have been turned off. This stops these inactive areas from "short-circuiting" the still active areas of the micro-pump. This method also allows those sub-systems still, operating to do so at their optimum operating point in terms of voltages and frequencies applied.

Thus, the number of channels being actuated can be varied in response to the varying volume flow rate requirements of the pumped system. There may be, for example, more than ten, several tens, more than one hundred, or even several hundred channels in order to pro vide the amount of total flow required. The channel s, controller and non-return valves may be arranged so that any block 66 of channels that can be switched on and off is associated with a pair of conventional non-return valves 67 to prevent reverse flow through those channels when they are switched off. The number of channels in each such switchable block may vary from block to block within a given pump. For instance, the number may vary as a binary series: 1,2,4 etc., or multiples thereof. FIG. 31 shows a schematic of how this would be arranged with the additional non-return valves 67 dividing the system in the ratios 1:2:4. In this way, by switching a small number of different blocks in and out of operation, a wide range of total flow rates would be available. In this example, volume flow rates from zero to seven in increments of one would be possible by selection of zero to three pumping blocks.

Figure 32:
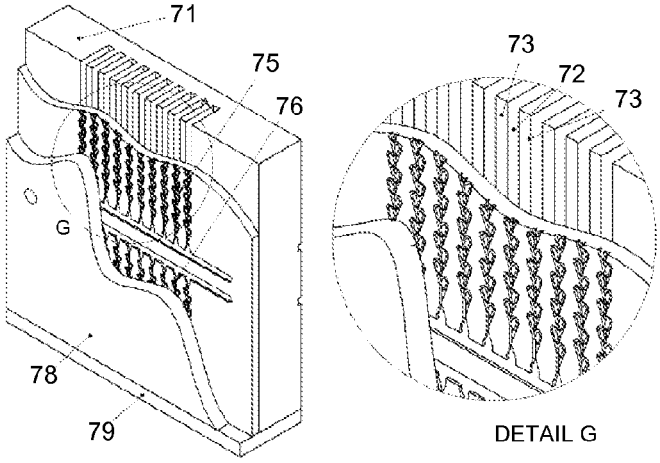
FIG. 32 shows a schematic perspective view of the pump of FIG. 10 with parallel shared-wall piezo actuators and a Tesla diode array.

As discussed earlier, in some applications there is a need to minimise pressure fluctuations. One embodiment of the invention is designed to produce pumping systems where the periodic changes in pressure and flow rates from positive displacement pumping devices are actively cancelled out, so as to produce a pump whose output is substantially free of periodic pressure pulses and whose output flow rate is substantially constant. This can be done by arranging for an array of substantially identical volume displacement elements to be assembled, as shown in FIG. 32. Volume displacement chambers 72 and displacement elements are produced by sawing channels in a wafer 71 of piezo-ceramic material. Each volume displacement chamber 72 periodically changes its internal volume when the displacement element is actuated, for example, by flexing two of its chamber walls 73. Each volume displacement chamber 72 is connected to inlet and outlet fluidic diodes 75 and 76, thus producing an array of individual positive displacement pumping elements 77. The fluidic diodes 75 and 76 are sealed with a cover component 78 that also provides the inlet and outlet ports to the external system to be pumped. The assembly is completed by end covers 79 (of which only one is shown for clarity). A plurality of such individual pumping elements are then arranged to work together in pairs, triplets or fours, driven by two, three or four phase waveform schemes respectively. Systems with larger numbers of phases are also possible, using the same general technique, but will not be described further herein.

Each volume displacement element is capable of displacing volume increments that are directly proportional, or substantially proportional, to the magnitude of the electrical signal applied to them to cause the actuation. The upstream inlets to the separate inlet fluidic diodes are joined together so that the rectified flows are added together to produce a combined inlet flow in the external circuit to be pumped. Similarly, the downstream outlets from the separate outlet fluidic diodes are joined together so that the rectified flows are added together to produce a combined outlet flow in the external circuit to be pumped, in this configuration, it is possible to apply particular waveforms to the pumping devices so that although each individual device still produces periodic changes in pressures and flow rates into and out of its respective fluidic diodes, when combined with its neighbours' flows, the total flow rates and pressures from the double, triple or quadruple arrangement in the common inlets, outlets and external pumped system are constant, or substantially constant.

The blocks of pairs, triplets or quadruplets pumping elements can themselves be replicated to form arrays of pumping devices in parallel, so as to be able to build pumps to match the required volume flow rate. These arrays can, in turn, be arranged in series to allow higher pumping pressures to be achieved than is possible with a single parallel array. Additionally, miniature or macroscopic conventional non-return valves may be used to prevent reverse flows through the pump, or sections of the pump, when all or part of the pump is de-activated.

Figure 33:
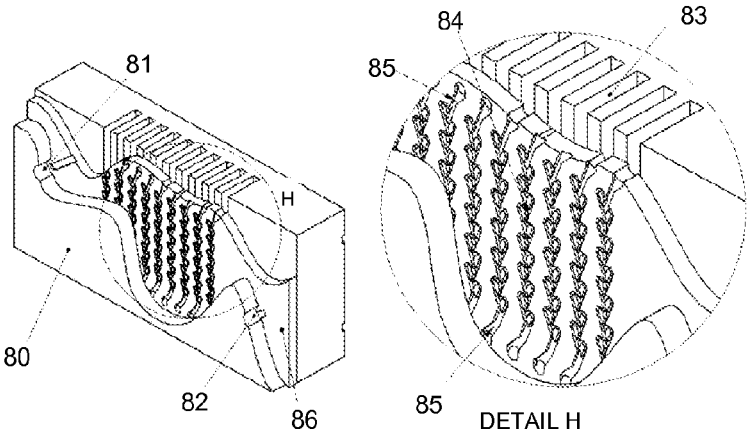
FIG. 33 shows a schematic perspective view of the pump of FIG. 11 with series shared-wall piezo actuators and an array of Tesla diodes.

Thus, the use of piezo actuators working in shear mode, with each wall shared between two pumped chambers readily allows individual arrays to be arranged in series to enable higher total differential pressures to be generated. Referring to FIG. 33 and back to FIG. 11, in a series configuration, channels and actuating wall elements are again made by sawing a wafer of piezo-ceramic. Liquid enters via the inlet port 81 and is fed to the left-hand most of the individual pumping elements 83 formed in a silicon substrate 86. These are daisy-chained together so that the output from each pumping chamber is connected directly to the input of the next of the neighbouring pumping chambers via a single fluidic diode 84 and dog-leg section 85. The output from this second pumping chamber is connected to the input to the next pumping chamber in the array in the same way, and so on, until the fluid exits through the outlet port 82. The fluidic diodes are sealed with a cover component 80 and end covers (not shown).

Figure 34A:
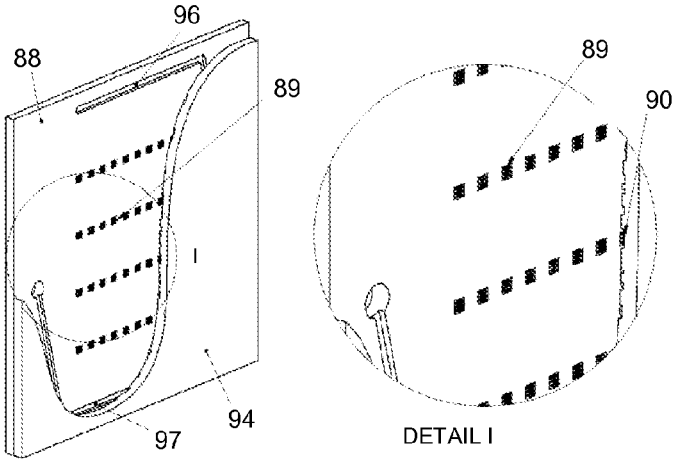

Bubble actuation provides a relatively cheap and effective way of providing a means of actuating certain fluids, the limitation being that the fluids must contain a volatile fraction in order for the thermal elements to create the necessary bubbles. The proportion of volatile fraction generally needs to be at least half of the total for the method to be effective. An example of a bubble actuated pump is shown in FIGS. 34A and 34B in which the pump features a row of ten bubble chambers and Tesla diode pairs in parallel, with four bubble chambers in series in each. The compact nature of the bubble chambers and diodes means that bubble chambers and diodes can be readily daisy-chained together to allow higher differential pressures to be achieved. An example of a short daisy chain arrangement is shown in FIGS. 34A and 34B. In this arrangement, alternate bubble chambers in the chain are actuated in anti-phase to one another, so that as the bubble in one chamber is expanding, the bubbles in the chambers immediately upstream and downstream will be collapsing. Flow moves forward through one of the diodes, but is resisted by the other, thus causing an element of fluid to be moved along the chain. The process is repeated in the next half cycle, but with the expansions and contractions of the bubbles occurring in the alternate bubble chambers. These small series arrangements can be used in parallel and FIGS. 34A and 34B show a small example of this arrangement. Such arrays can be added to in order to achieve the required flow rates and differential pressures for the application in question. The necessary resistive elements 89 are conveniently produced by evaporating conductive films in the form of tracks on to the surface of silicon wafers 88. The bubble chambers 90, 91 are can be small in scale-measuring only a few tens of microns in size, leading to the overall size of the pump being very compact. The fluidic diodes 92, 93, as well as the bubble chamber itself 91, can be fabricated using DRIE methods in a silicon wafer 94, 95. Again, the DRIE etched component can be used as a master to produce a mould or embossing tool to allow low-cost plastic diode components to be produced in volume.

Each bubble chamber 91 is connected to two fluidic diodes 92 and 93, one feeding into, and one feeding out of it. The other ends of the diodes are connected either to the common input 96 and output lines 97 respectively, or to further bubble chambers. A cover plate 99 is positioned over the silicon wafer 95. In order to reduce the fluctuations in static pressure in the external circuit and in overall flow rates, neighbouring channels may, in general, be actuated at different phase angles to one another. The optimal number of phases will be a function of the dynamics of bubble generation and collapse, and will need to be established experimentally for each design of pump.

FIG. 35 shows a small array of electrostatic actuator elements combined with Tesla Valvular Conduits to form a pump for pumping air and gases. Each pumping element consists of a pair of shallow chambers 100, moulded into a pair of polymeric wafers 101 and 102, separated by a thin sheet of polymeric material 103, that forms the actuating element in the form of a diaphragm. Each chamber is connected to an input and an output diode 104 and 105. The inputs to the upstream diodes are connected together via a manifold. The actuation mechanism works by applying a high resistivity film to the polymeric diaphragm, which is raised to a high voltage. Electrodes 106 applied to the outer surfaces of the device, either side of the pumping chambers have electrical signals applied to them to produce a high electrostatic field in the pumping chambers. The voltages applied to the pairs of electrodes are alternating and in anti-phase to one another, thus applying an alternating force to the diaphragm. The diaphragm oscillates, alternately drawing air into and expelling it, from each of the chambers via the fluidic diodes 104 and 105. Air is thus drawn from the external circuit via the inlet port (not shown), into the inlet manifold 107, through the pumping elements to the outlet manifold 108 and out through the outlet port 109 to the external circuit.

As with the previously described devices designed for pumping of liquids, it is possible to connect individual electrostatic actuating elements and fluidic diodes in series so as to produce higher pressures than can be achieved from single actuator diode systems. Alternatively, as before, parallel arrays can be arranged in series to achieve higher pressures. Electromagnetic actuation is widely used in the manufacture of conventional loudspeakers. Loudspeaker type actuators are good candidates for the manufacture of air pumps based on the present invention, possessing as they do the necessary linear response characteristics, together with the ability to produce high frequency motion of an actuating element. As efficient electromagnetic actuators tend to be relatively bulky, numbers of individual diaphragms of the same phase could be beneficially connected together and driven from the same actuator. Two, three or four such arrays would be connected together with common manifolds and driven with the same profiled, phased waveforms to produce smooth flows. As with the previously described devices designed for pumping of liquids, it is possible to connect individual electrostatic actuating elements and fluidic diodes in series so as to produce higher pressures than can be achieved from single actuator diode systems.

FIGS. 36A-36C show a further possible embodiment and illustrate a plurality of flexing elements 110 (each of which is a piezo diaphragm working in shear mode) that sit between two chambers 111, so that as the flexing elements 110 move in one direction, one of the chambers 111 draws in fresh fluid, whilst the other expels it. The chambers 111 are formed by etching the reverse side of a pair of silicon wafers 112 from which the fluidic diodes are formed and the flexing elements are formed from a piezo electric diaphragm 113, which is sandwiched between the two silicon wafers 112. So once again, fluid enters via a diode, passes through a hole at the end of the pumping channels, passes up the pumping channel and out via a second diode. Either side of the diaphragm are essentially separate pumps, with the same flow rates at any given moment, which may or may not be joined together in series or parallel at the inputs and outputs. This implementation can use two, three, four or more phases and all the same waveforms as previously described. Covers 114 are positioned on either side of the assembly.

It will be appreciated that aspects described with reference to apparatus may be applied to methods and vice versa. The skilled reader will appreciate that apparatus embodiments may be adapted to implement features of method embodiments and that one or more features of any of the embodiments described herein, whether defined in the body of the description or in the claims, may be independently combined with any of the other embodiments described herein.

It will thus be apparent that at least some of the embodiments of the micro pump do not require external damping elements to achieve smooth flows. Damping elements (weirs or accumulators) add size, weight, complexity and cost and reduce functionality because they need to be kept in the same orientation with respect to gravity. Non-sinusoidal motion—triangular, trapezoidal or parabolic from multiple actuating elements allow smooth flow rates, if the individual flow profiles can be arranged so that the individually time-varying profiles of flow rates through the rectifying valves from different phases sum together at all times to the same total value. To achieve the rapid accelerations of the actuating elements needed for the triangular or trapezoidal (but not parabolic) profiles, the actuating elements are preferably capable of responding to higher harmonics (especially third and fifth harmonics, based on Fourier theory). They should therefore to be capable of between 5× and 10× the base frequency of the working device. Overall, the parabolic profile drive waveforms are probably the best, however the other drive waveforms may well be more appropriate in some cases. The use of Tesla and nozzle diffuser valvular conduits improves the diodic properties (ratios of forward to re verse flows in response to symmetrically varying pressure inputs) of the valvular conduits as the driven frequency increases. Therefore, actuating elements with high natural and operating frequencies are preferably chosen in some embodiments. This, in turn, leads to each element being physically small, because natural frequencies increase with diminishing scale, all other things being equal. Thus, in order to achieve significant flow rates, dozens or hundreds of elements working in parallel may be needed. This is readily achieved with the parallel processing available with MEMS processing. Of course, conventional non-return valves do not respond in the same way to increasingly high frequencies of actuation—their inertia causes them to oscillate about an intermediate half-open state. However, if combined in series with fluidic diodes, they can be required only to pass fluid that is flowing at a constant rate if the device is actuating, or to resist reverse flows if the device is not actuating, both of which they can easily do. Therefore, conventional non-return valves can be used to divide up an array into functional blocks of different numbers of actuating elements, so as to form a "digital array", for example an array divided into blocks whose flow rates form a binary sequence of 1,2,4,8 etc. By selecting suitable combinations of these blocks to be turned on or off, a range of flow rates can be achieved, in increments of 1 flow unit.

It will be apparent that the choice of actuating means or of the design of the valvular conduit or the non-return valves may depend on the above considerations. Any actuating element can, in principle, be combined with any valvular conduit or non-return valve. For example, actuating elements that are shared by two pumping chambers maybe preferred because, by definition, the total volume contained by the pump remains constant, as any increase in the volume of one chamber is matched by a reduction in the volume of its neighbour. This, in turn, means that the pump does not periodically exchange fluid with the external circuit, so that the static pressure in the external circuit remains constant. However, for applications where high differential pressures are required, but where smoothness of flow rates may be less important, the fluidic diodes may be placed between neighbouring actuating elements. Here, as one chamber contracts, its neighbour expands by precisely the same amount and fluid can flow from one to the other via the diode. These can be put together into chains to produce high differential pressures from a compact structure. Another advantage of this arrangement is that the differential pressure across any of the actuating elements is limited to the pressure across the associated diode, and is therefore modest. Application of these principles, but using electrostatic actuation of flexible membranes to produce relatively large volume displacements at lower pressures allows the construction of pneumatic pumps, while the piezo actuated devices are better suited to pumping of liquids.

In one implementation, the maximum pressure delivered by the pump can be increased by connecting pumping elements in series. Here, the fluidic diodes connect each channel to its two neighbours in a daisy chain. This permits larger differential pressures to be generated than is possible with single elements working in parallel. In principle, a large number of elements can be connected in series, the overall differential pressure of the system then being close to the sum of all the pressures across the individual elements in the series. Because the static pressure rises incrementally from one chamber to its neighbour, the static pressure across any flexing element is limited to the pressure across the fluidic diode separating the two channels it separates, plus the alternating pressure generated from the flexing element. Thus the stiffness and strength of the flexing element can be optimised for pumping efficiency, rather than being compromised by the need to strengthen the flexing element to withstand the total pressure, in order to prevent rapture and escape of the pumped fluid to the outside.

It will therefore be seen that it is possible to produce a pump that can deliver a substantially constant flow of liquid at a substantially constant pressure without the use either of pressure accumulators or of servo valves. An implementation can be used to move air and gases against a range of back-pressures, with minimal pressure fluctuations and with relatively fast response times. Thus, a wide range of flow rates and pumping pressures can be achieved from a common modular basis. Therefore some embodiments allow fluidic pumps to be produced that benefit from a modular architecture, constructed of an array of standardized subsystems, capable of a wide range of maximum flow rates and maximum pressures according to the application, thereby providing, is some embodiments, a low cost of manufacture. Various embodiments allow accurate control of fluid flow rates around the external circuit to be supplied, as well as low levels of pressure fluctuations, high speed of response, compact size, low weight, high energy efficiency, and high thermodynamic efficiency. In some embodiments, there is no necessity for sliding or rotating parts to stick or block up or to damage delicate fluid components, and embodiments therefore provide the ability to pump a wide range of fluid types, including fluids having from low to high viscosities, different fluid chemistries, and shear-sensitive or pressure-sensitive fluids, as well as having high reliability and a long lifetime.

It will further be appreciated that although only a few particular embodiments of the invention have been described in detail, various modifications and improvements can be made by a person skilled in the art without departing from the scope of the present invention.

What is claimed is:

1. A micro pump, comprising:

a common inlet channel;

a common outlet channel;

a plurality of pumping elements, each pumping element having an inlet coupled to the common inlet channel and an outlet coupled to the common outlet channel, the inlet and outlet being connected by a microfluidic channel arranged on a substrate;

a plurality of actuating elements arranged to cause fluid to be pumped through the microfluidic channels from the inlets to the outlets thereof; and a controller coupled to actuate the actuating elements so as to produce substantially continuous steady flow of the fluid at the common outlet channel, wherein the microfluidic channel comprises a valvular conduit having a first fluid flow resistance in a direction from the inlet to the outlet and a second fluid flow resistance in a direction from the outlet to the inlet, wherein the first fluid flow resistance is lower than the second fluid flow resistance and at least one of the valvular conduits comprises a rectifying structure;

wherein the controller actuates the actuating elements of the microfludic channels a third of a cycle out of phase-lead with respect to their neighbours to one side and a third of a cycle of phase-lag with respect to their neighbours on the other side, by using input voltage versus time drive waveforms to control the actuating elements so as to produce a pressure versus time history in each actuating element that is trapezoidal in profile, by arranging that each actuating element moves at a constant speed from one end of its travel to the other in a third of a cycle, dwells for a sixth of a cycle, moves back again at a constant speed in a third of a cycle and dwells for a sixth of a cycle.

2. A micro pump according to claim 1, wherein the rectifying structure comprises a plurality of topographical micromixers that split, turn, and recombine the fluid arranged in series in the valvular conduit.

3. A micro pump according to claim 2, wherein the rectifying structure comprises a Tesla structure.

4. A micro pump according to claim 1, wherein at least one of the microfluidic channels comprises a pair of valvular conduits and a pumping chamber arranged between the valvular conduits, at least one of the plurality of actuating elements being arranged adjacent to the pumping chamber.

5. A micro pump according to claim 4, wherein pumping chambers of adjacent microfluidic channels share at least one of the actuating elements, wherein at least one of the actuating elements is arranged to cause fluid to be pumped through the adjacent microfluidic channels in two or more phases.

6. A micro pump according to claim 1, wherein the controller actuates the actuating elements at mutually staggered relative timing.

7. A micro pump according to claim 6, wherein the controller actuates the actuating elements to operate at substantially the same frequency, but shifted in phase to each other.

8. A micro pump according to claim 6, wherein the controller actuates the actuating elements in two or more phases, to move in such a way that the average speeds of the actuating elements, and therefore the rates of volumetric displacement within the actuating elements from the two or more phases sum to a constant total value at any given point in time throughout one or more cycles of operation.

9. A micro pump according to claim 1, wherein at least one of the actuating elements comprises a piezoelectric transducer (PZT) diaphragm.

10. A micro pump according to claim 1, further comprising:

at least one mechanical non-return valve positioned between the common inlet channel and the inlets of one or more of the pumping elements, the mechanical non-return valve allowing flow into the respective microfluidic channel, but preventing reverse flows.

11. A micro pump according to claim 1, further comprising at least one mechanical non-return valve positioned between the common outlet channel and the outlets of one or more of the pumping elements, the mechanical non-return valve allowing flow out of the respective microfluidic channel, but preventing reverse flows.

12. A micro pump according to claim 1, further comprising a plurality of non-return valves positioned in the common inlet channel and in the common outlet channel between the inlets of one or more of the pumping elements so as to sub-divide the plurality of pumping elements into a number of functional blocks.

13. A micro pump according to claim 12, wherein the non-return valves positioned in the common inlet channel and in the common outlet channel are arranged so that the functional blocks form an array of functional blocks, where the functional blocks of the array have an increasing number of pumping elements within each functional block that increases as a binary series.

14. A micro pump according to claim 12, wherein the functional blocks are controlled to adjust the total flow rate of the micro pump by arranging for an electrical drive circuit to correspond to the functional blocks, so that by turning a particular drive circuit on or off, each corresponding functional block is caused to start or stop pumping so as to match demand from an external load.

15. A micro pump according to claim 1, wherein at least one of the actuating elements comprises a bubble generator for creating a bubble in the fluid by a heater, growth of the bubble causing propulsion of the fluid.

16. A micro pump according to claim 1, wherein at least one of the actuating elements comprises a diaphragm driven by electrostatic or electromagnetic forces.

* * * * *